US005801729A

United States Patent [19]

Kitamura et al.

[11] Patent Number: 5,801,729

[45] Date of Patent: Sep. 1, 1998

[54] IMAGE FORMING DEVICE WITH APERTURE ELECTRODE BODY

[75] Inventors: Tetsuya Kitamura, Gifu; Tomoaki Hattori, Nagoya, both of Japan

[73] Assignee: Brother Kogyo Kabushiki Kaisha, Nagoya, Japan

[21] Appl. No.: 533,783

[22] Filed: Sep. 26, 1995

[30] Foreign Application Priority Data

| | | | |
|---|---|---|---|
| Sep. 30, 1994 | [JP] | Japan | 6-237324 |
| Oct. 26, 1994 | [JP] | Japan | 6-287250 |
| Oct. 26, 1994 | [JP] | Japan | 6-287251 |
| Nov. 18, 1994 | [JP] | Japan | 6-309783 |

[51] Int. Cl.[6] ..... G03G 15/16

[52] U.S. Cl. ..... 347/55; 347/102; 347/103

[58] Field of Search ..... 347/55, 102, 103; 355/259

[56] References Cited

U.S. PATENT DOCUMENTS

| | | | |
|---|---|---|---|
| 3,689,935 | 9/1972 | Pressman et al. . | |
| 5,036,341 | 7/1991 | Larsson . | |
| 5,132,712 | 7/1992 | Fletcher et al. | 346/159 |
| 5,305,026 | 4/1994 | Kazuo et al. | 347/55 |
| 5,353,105 | 10/1994 | Gundladi et al. | 355/279 |
| 5,473,352 | 12/1995 | Ishida | 347/55 |

FOREIGN PATENT DOCUMENTS

| | | |
|---|---|---|
| 4-152154 | 5/1992 | Japan . |
| 6-155798 | 6/1994 | Japan . |

*Primary Examiner*—Daniel P. Malley
*Attorney, Agent, or Firm*—Oliff & Berridge, PLC

[57] ABSTRACT

When a toner image formed on the belt is transported to the transport path of the image recording medium, the image recording medium is caused to abut the belt by the rollers and so that the toner image on the belt is transferred to the image recording medium. Also, the belt heated by the heat roller heats the image recording medium and thermally fixes the toner image to the image recording medium. Thus, thermal fixation is simultaneously achieved with transfer of the image to the image recording medium.

32 Claims, 24 Drawing Sheets

IMAGE FORMING DEVICE WITH APERTURE ELECTRODE BODY

BACKGROUND OF THE INVENTION

1. Field of the Invention

The present invention relates to an image forming device used, for example, in a copy machine, printer, plotter, or facsimile machine. More particularly, the present invention relates to an image forming device employed with an aperture electrode body.

2. Description of the Related Art

U.S. Pat. No. 3,689,935 describes a toner jet type image forming device. Japanese Patent Application KOKAI No. HEI-6-155798 describes the same type of toner jet type image forming device. The toner jet type image forming device is provided with an aperture electrode body in which are formed a plurality of apertures. A control electrode is formed around each aperture. A drive signal is selectively, that is, according to an image signal from an external source, applied to the control electrodes to control passage of toner through the apertures. Toner that passes through the apertures impinges on print sheet, or other image recording medium, to form a toner image. The image recording medium with the toner image formed thereon is thermally pressed by a fixing unit made from, for example, a heated roller, to fix the toner image onto the image recording medium.

The image recording medium must be transported to a position extremely near, for example, within 1 mm from, the aperture electrode body or less to insure that toner, supplied from the toner supplying mechanism, moves to desired position on the recording medium. This level of precision is difficult to maintain with a thin and flexible image recording medium such as paper, so the image recording medium may sometimes contact the aperture electrode body. This can cause problems that adversely affect the quality of the recorded image. For example, the toner image can be smudged before it is fixed onto the image recording medium. Also, foreign matter, such as paper particles that are abraded off the image recording medium, can cling to the aperture electrode body and interfere with control of toner. Additionally, this narrow gap prevents use of thick recording media in the image forming device. Therefore, the image forming device can not be used for forming images on thick recording media.

Also, the aperture electrode body is generally formed to an extremely thin shape, for example, to about 25 μm. For this reason, when the image recording medium contacts the aperture electrode body, the shock of contact can damage the aperture electrode body so that formation of images is impaired.

In contrast to this, Japanese Patent Application KOKAI No. HEI-4-152154 describes an example of an image forming device wherein the image recording medium is not disposed directly in opposition to the aperture electrode body. Instead, the toner image is first formed on an aluminum transfer drum (intermediate recording medium), which is disposed in opposition to the aperture electrode body. The toner image is then transferred from the intermediate recording medium onto the image recording medium.

In the image forming device of the document No. HEI-4-152154, the transfer drum disposed between the aperture electrode body and the image recording medium is in partial contact with a back electrode. The transfer drum is provided to rotate in synchronization with transport of the recording medium. Toner passes through the apertures of the aperture electrode body and clings to the transfer drum. Rotation of the transfer drum transports the toner image to a transfer position, where the toner image is transferred to the recording medium by a transfer mechanism made from a transfer corona. A fixation mechanism then fixes the toner image to the image recording medium. This structure allows formation of images on image recording mediums made from resin, metal, or other materials.

Although a thin flexible image recording medium will sometimes sag and contact the aperture electrode body when the image recording medium directly opposes the aperture electrode body, this will not happen when the intermediate recording medium formed from the aluminum drum is disposed between the image recording medium and the aperture electrode body. Also, paper particles and the like will not fall onto the aperture electrode body. Therefore, the image forming device can form images of superior quality.

The processes of forming the toner image on the intermediate recording medium, transferring the toner image to the image recording medium, and thermally fixing the toner image to the image recording medium, that is, heating the image recording medium with the transferred toner image formed thereon, are individually performed in the image forming device provided with the intermediate recording medium. Consumption of power is therefore increased because each process consumes energy.

Because the device requires both the transfer mechanism for transferring, at the predetermined transfer position, the toner image from the transfer drum to the recording medium and the fixing mechanism for fixing the toner image to the image recording medium. Accordingly, the image forming device requires a large housing to house these components. Also, these extra parts complicate assemblage and adjustment of the image forming device. Especially, the transfer drum can only be positioned with limited freedom in the housing of the image forming device. Space in the image forming device can not be efficiently used so that the device must be made with a large size.

Electrostatic force generated by the high voltage of the back electrode causes toner that passes through the apertures to cling to the intermediate recording medium. At first, the toner clings to the intermediate recording medium as a result of the relatively large electrostatic force generated by the back electrode. As the intermediate recording medium rotates, the toner moves away from the back electrode and toward the transfer position. The toner can, however, still cling to the intermediate recording medium by van der Waals forces of toner and image forces occurred between the toner and the intermediate recording medium.

Toner is not formed from perfectly spherical particles, but is made up of particles having many protrusions. The toner clings to the intermediate recording medium in clumps formed by layers of toner two or three particles thick. Toner particles cling to the intermediate recording medium and to other particles by contact at their protruding points. Therefore, when the toner clings to the intermediate recording medium by van der Waals forces and image forces as described above, it is preferable to increase clinging tenacity with which the toner clings to the intermediate recording medium. This will prevent the large mass of each toner clump from causing some of each toner clump to fall off the intermediate recording medium during transport, and will form clean pixels and images.

SUMMARY OF THE INVENTION

It is therefore an objective of the present invention to overcome the above-described problems and to provide a compact image forming device that has low power consumption and that is capable of forming images with consistently high quality.

It is another objective of the present invention to increase the clinging tenacity with which toner, that has passed through apertures of the aperture electrode body, clings to the intermediate recording medium, thereby preventing toner from falling off the intermediate recording medium so that it can be reliably transferred to the image recording medium.

In order to attain the above object and other objects, the present invention provides an image forming device for forming a toner image on an image recording medium, the device comprising: an aperture electrode body formed with a plurality of apertures and having an electrode for each of the plurality of apertures; a toner supply unit for supplying toner to the plurality of apertures of the aperture electrode body; toner control means for controlling passage of toner through the apertures by individually controlling voltage supplied to each electrode of the aperture electrode body; intermediate recording medium provided on an opposite side of the toner supply unit with regards to the aperture electrode body, toner having passed through the apertures of the aperture electrode body clinging to the intermediate recording medium to form a toner image on the intermediate recording medium, the intermediate recording medium transporting the toner image to a predetermined transfer position; and transfer means for heating the toner image while contacting the intermediate recording medium to the image recording medium at the transfer position, thereby simultaneously transferring and fixing the toner image to the image recording medium.

The transfer means may preferably include: abutment means for abutting the image recording medium against the intermediate recording medium at the transport position; and heating means, disposed in opposition to the abutment means and sandwiching the intermediate recording medium and the image recording medium between the heating means and the abutment means, for heating the intermediate recording medium.

The intermediate recording medium may preferably be formed with a rough surface for boosting clinging tenacity with which toner clings to the intermediate recording medium.

The device may further comprise preheating means for heating toner clinging to the intermediate recording medium to soften the toner, thereby increasing tenacity at which toner clings to the intermediate recording medium.

The intermediate recording medium may be made from a thermal resistor. The transfer means may include energizing means for energizing the intermediate recording medium at least at the transfer position so as to thermally fix the toner image to the image recording medium.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
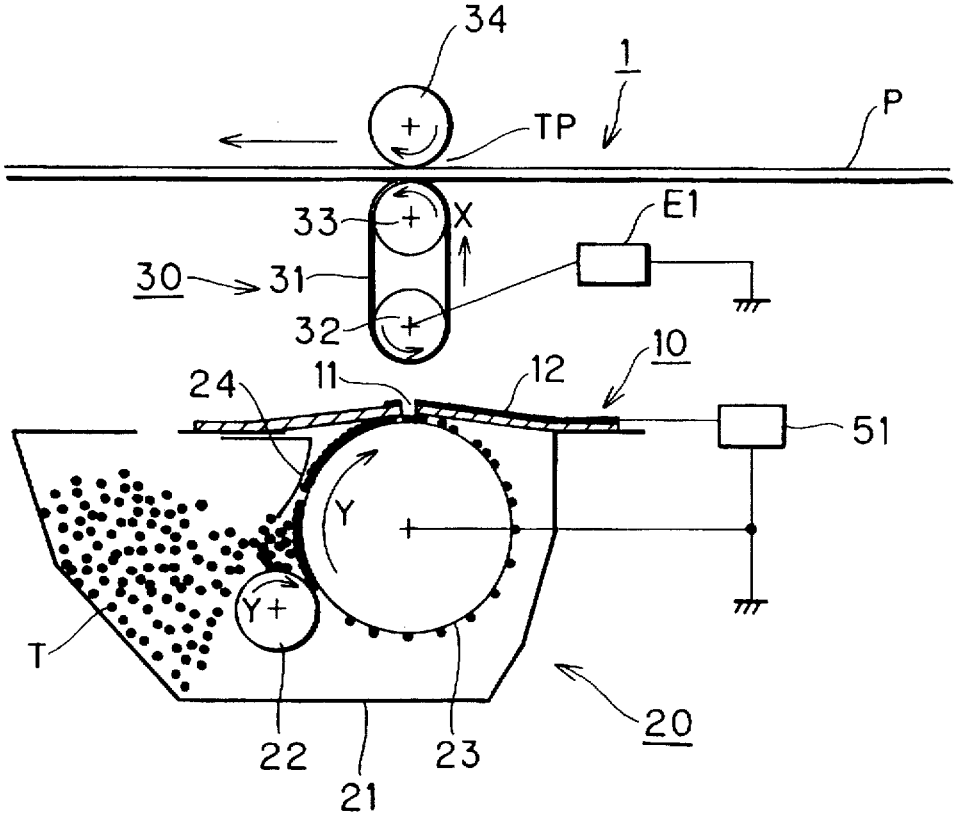
FIG. 1 is a schematic view of an image forming device of a first embodiment according to the present invention.

An image forming device according to preferred embodiments of the present invention will be described while referring to the accompanying drawings wherein like parts and components are designated by the same reference numerals to avoid duplicating description.

An image forming device of a first embodiment of the present invention will be described below with reference to FIGS. 1 through 5.

FIG. 1 is an explanatory diagram schematically showing an image forming device 1 of the first embodiment. The image forming device 1 is for forming monochromatic images. The image forming device 1 includes an aperture electrode body 10, a toner supply unit 20 provided beneath the aperture electrode body 10, and an intermediate recording mechanism 30 positioned above the aperture electrode body 10 and separated therefrom by a predetermined distance (for example, 0.5 mm). Although not shown in the drawing, a transport mechanism is provided for transporting an image recording medium P along a predetermined transport path. These components are all housed in a frame (not shown in the drawing).

Figure 2:
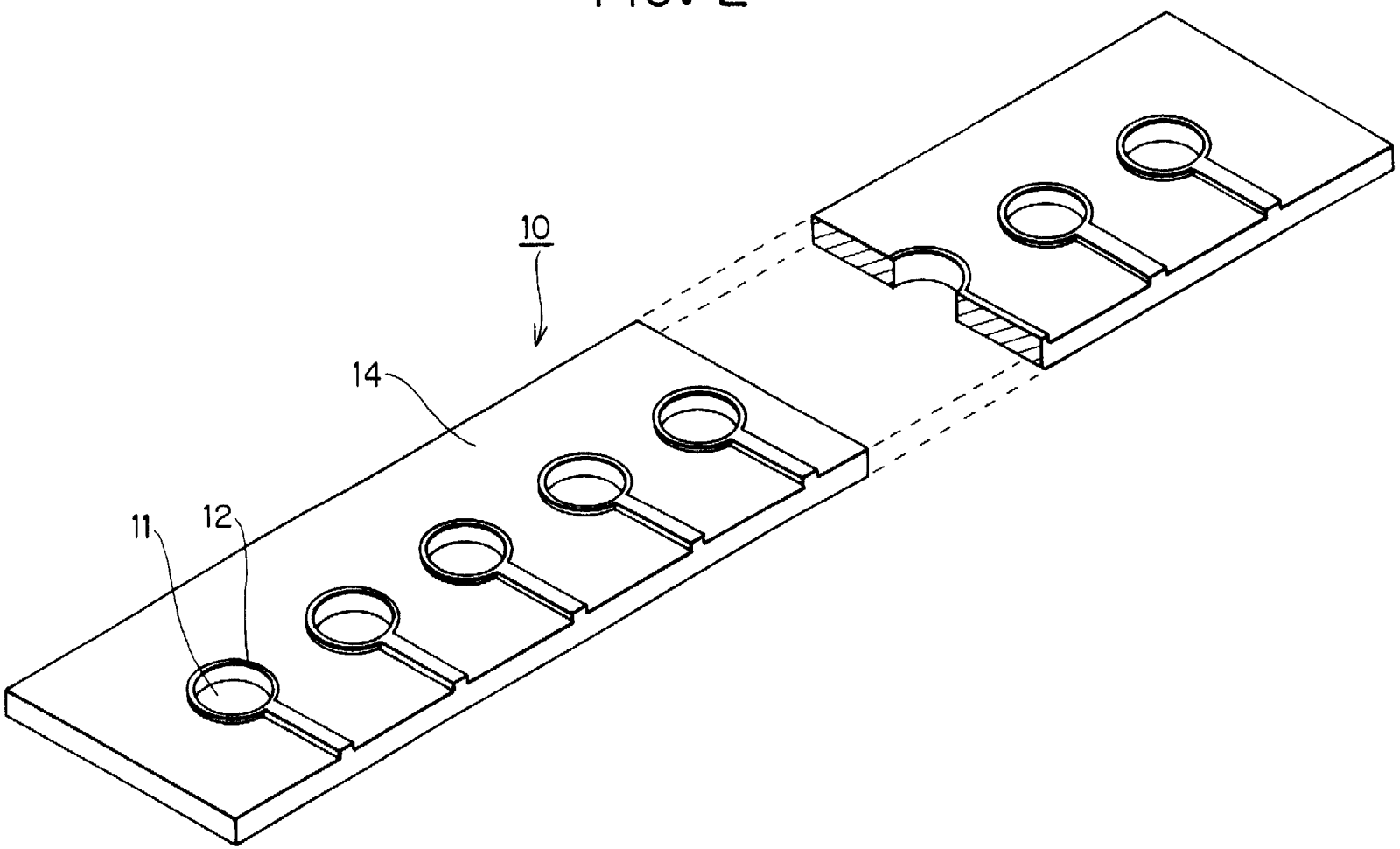
FIG. 2 is a perspective view of an aperture electrode body employed in the image forming device of FIG. 1.

As shown in FIG. 2, a plurality of apertures 11 are formed in the aperture electrode body 10. Around each of the apertures 11 is formed a control electrode 12 for controlling passage of toner T through the apertures 11. The control electrodes 12 for all the apertures 11 are connected to a control voltage application circuit 51.

The toner supply unit 20 stores therein and supplies, to the aperture electrode body 10, toner T for forming images the toner supply unit 20 and the aperture electrode body 10 form an image forming mechanism) ultimately on an image recording medium P, such as recording paper or sheets for use in overhead projectors. The toner supply unit 20 includes a toner case 21 serving as a housing of the toner supply unit 20; a cylindrical toner-bearing roller 23 rotatably supported in the toner case 21; a cylindrical supply roller 22 rotatably supported in the toner case 21 in parallel with and in contact with the toner-bearing roller 23; and a resilient plate-shaped toner regulating blade 24 positioned above the supply roller 22 so as to be pressed against the roller surface of the toner-bearing roller 23.

A drive circuit (not shown in the drawings) drives the toner-bearing roller 23 and the supply roller 22 to rotate at a predetermined speed in the clockwise direction of FIG. 1, that is, in the direction indicated by the arrow Y. An electrode body that is electrically grounded to develop an electric potential of 0 V covers the surface of the toner-bearing roller 23.

According to the present invention, the intermediate recording mechanism 30 includes an endless and seamless belt (intermediate recording medium) 31 stretched around and between a back-electrode roller 32 and a thermal roller 33. The back-electrode roller 32 is made from a metal, and is positioned in opposition to the toner supply unit 20 with the apertures 11 sandwiched therebetween. The thermal roller 33, which has therein an internal heater such as a halogen heater for heating the belt 31 to a predetermined temperature, is provided at a position adjacent to the transport path of the image recording medium P.

A pressure roller 34 is provided at a position opposing the thermal roller 33 with the belt 31 sandwiched therebetween. The pressure roller 34 operates with the thermal roller 33 to transport the image recording medium P, i.e., acts as a transporting mechanism, while pressing it against the belt 31.

A drive circuit (not shown in the drawings) drives the back-electrode roller 32 and the thermal roller 33 to rotate at a predetermined speed in the counter-clockwise direction of FIG. 1 as indicated by the arrows X in the figure, thus transporting the belt 31 at a predetermined speed. The drive circuit also drives the pressure roller 34 so as to transport the image recording medium P and the belt 31 at the same speed.

An external computer, an image retrieval device, an image transmission device, or some similar device is connected to, and inputs image data to, the control voltage application circuit 51. The control voltage application circuit 51 applies, according to image data inputted from the external source, an image forming voltage (for example, positive 30 V) or an image non-forming voltage (for example, negative 30 V) to each of the control electrodes 12.

A DC power source E1 is provided for applying a predetermined high voltage of, for example, 500 V, to an entire peripheral surface of the back-electrode roller 32, thereby forming an electric field of predetermined force between the back-electrode roller 32 and the control electrodes 12.

Figure 4:
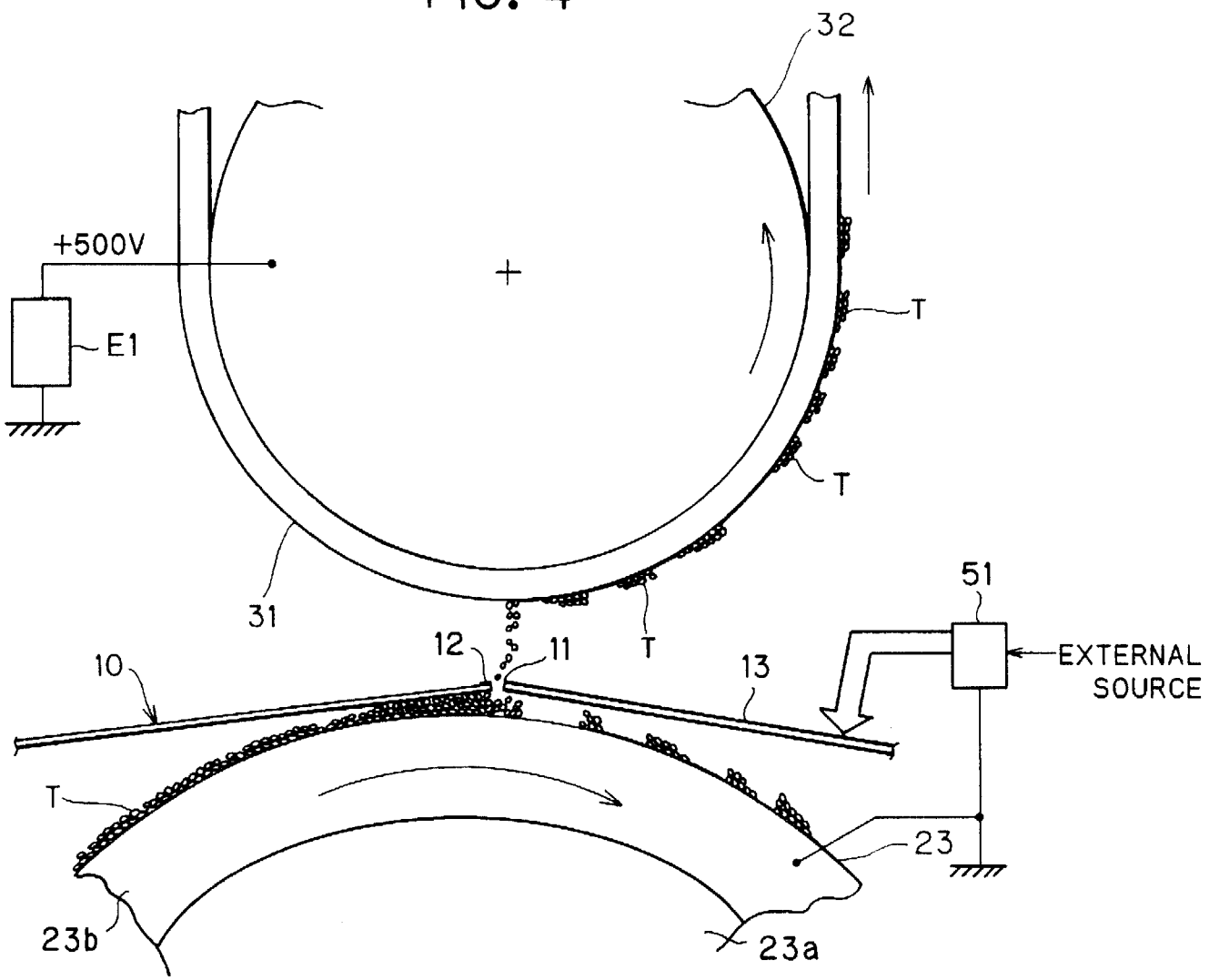
FIG. 4 is an enlarged side view showing how toner clings to an intermediate recording medium.

Next, a detailed description will be provided for the toner supply unit 20. The toner case 21 has a width about the same as the width of the recording sheet P. The toner case 21 is filled with toner. The toner has electrically insulating properties. The rollers 22 and 23 are both rotatably supported in the toner case 21 to extend horizontally. For example, as shown in FIG. 4, the toner-bearing roller 23 is formed from a sponge roller 23*a* and a nickel sleeve 23*b* formed to the periphery of the sponge roller 23*a*. The nickel sleeve 23*b* is electrically grounded. An insulating coating layer made from an insulating material can be formed to the surface of the toner-bearing roller 23.

The resilient toner regulating blade 24 having a thin plate shape is attached at one of its ends to the toner case 21. A curved portion of the toner regulating blade 24 presses against the toner-bearing roller 23. The toner regulating blade 24 regulates, to predetermined amounts, the charge and volume of toner T supplied by the toner supply roller 22 and clinging to the surface of the toner-bearing roller 23.

In the toner supply unit 20 with the above-described structure, the rotation of the supply roller 22 transports the toner T stored within the toner case 21 toward the toner-bearing roller 23. The toner T transported to where the surfaces of the supply roller 22 and the toner-bearing roller 23 contact is given a negative charge when scrapped onto the toner-bearing roller 23. Rotation of the toner-bearing roller 23 transports the toner T born on the toner-bearing roller 23 toward the aperture electrode body 10. The toner layer regulating blade 24 distributes the toner into a thin layer of uniform thickness on the surface of the roller. After charge of each toner particle is equalized, the toner T is supplied to the aperture electrode body 10.

The aperture electrode body 10 is bent into the shape of roof and is attached by its edges to the upper edge of the toner case 21 so as to cover the toner case 21 and contact the upper edge of the toner-bearing roller 23. As shown in FIG. 2, the aperture electrode body 10 is formed from a heat-resistant insulation base 14 made from an approximately 25 μm thick sheet of polyimide resin. Apertures 11, each with a diameter of about 100 μm, are formed in a row following the lengthwise direction of the aperture electrode body 10. One of a plurality of control electrodes 12, each made from an approximately 8 μm thick film of copper foil, is formed around the opening perimeter of each aperture 11.

The aperture electrode body 10 is positioned so that the surface of the aperture electrode body 10 on which the control electrodes 12 are formed opposes the belt 31. The surface of the aperture electrode body 10 opposite to the surface where the control electrodes 12 are formed is in pressing contact with the upper portion of the toner-bearing roller 23. With this configuration, the toner T on the toner-bearing roller 23 is supplied to the underside of the apertures 11 by scraping against the insulation sheet 14 of the aperture electrode body 10.

Figure 3:
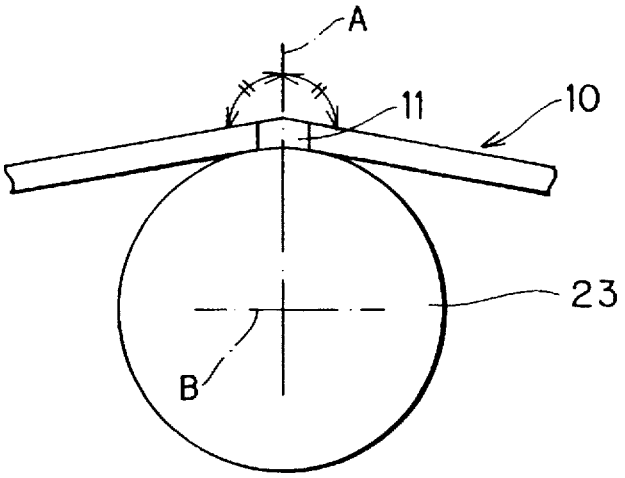
FIG. 3 illustrates a positional relationship between the aperture electrode body and a toner-bearing roller.

The positional relationship between the toner-bearing roller 23 and the apertures 11 of the aperture electrode body 10 will be described here in detail while referring to FIG. 3. Each aperture 11 is positioned so that its central axis A passes through the upper periphery of the toner-bearing roller 23 and intersects the central axis B of the toner-bearing roller 23. An interior area of each aperture 11 is therefore symmetrically located with respect to the uppermost position of the toner-bearing roller 23 to the left and right in the horizontal direction of FIG. 3. Toner T passing through each aperture 11 can therefore be distributed uniformly over the entire interior of each aperture 11. Also, toner T is drawn upward in a direction parallel with the wall of the apertures 11, so that movement of toner T will be steady.

The aperture electrode body 10 itself is pressed by the toner-bearing roller 23 so as to bend at an equal angle to the right and left of the center of the apertures 10. This brings the aperture electrode body 10 and the toner-bearing roller 23 into contact over a large surface area. The toner-bearing roller 23 presses the area under each aperture 10 to the same degree on both the left and right sides. Therefore, density of toner will be even and generation of distortions in toner density can be greatly suppressed.

Next, the intermediate recording mechanism 30 will be described in detail.

The belt (intermediate recording medium) 31 is an endless, seamless, belt made from a flexible resin film, such as polyimide, poly-amide, such as aromatic poly-amide, Teflon (trademark), and silicone, that has excellent toner release and heat-resistance properties. The belt 31 has a width substantially equal to the width of the recording medium P. The belt 31 may be formed with a width equal to or greater than the maximum width of the image recording medium P to be supplied to the image forming device 1.

To increase toner release properties of the belt 31, the surface of the resin film can be coated or impregnated with silicone oil. To remove electric charge from the belt 31, a layer in which carbon particles are dispersed can be formed to the surface of the resin film. This helps prevent reductions in image quality caused by dust and other foreign matter clinging to the belt 31. The belt 31 could alternately be formed from a metal film, such as a stainless steel or nickel film, instead of a resin film.

The belt 31 is mounted on and stretched between the back electrode roller 32 and the heat roller 33 (the two rollers 32, 33 forming a first transporting mechanism) that are aligned with the row of apertures 11 in the aperture electrode body 10. The pressing roller 34 is made of rubber, for example, and is positioned parallel to and in pressing contact with the heat roller 33 (the two rollers 33, 34 with belt 31 forming a second transporting mechanism). The rollers 32, 33 and 34 are driven by the drive circuit (not shown) to rotate in synchronization to transport the recording sheet P and the belt 31 at the same speed. A long halogen lamp is provided internally to the length of the heat roller 33. The heat roller 33 is heated to a predetermined temperature (about 130° C., for example) by application of a drive voltage supplied from a power circuit (not shown in the drawings) to the halogen lamp. The heat melts and fixes toner T that is transferred to the recording sheet P from the belt 31, i.e., the thermal roller 33, with the pressing roller 34, acts as a transfer device, as will be described later.

Next, operation of the image forming device 1 having the above-described structure will be provided with reference to FIGS. 1 and 4.

Upon application of an image signal from an external source, the control voltage application circuit 51 applies, according to the image signal, a positive 30 C voltage to the control electrodes 12 of apertures 11 through which toner T is to be passed and a negative 30 V voltage to the control electrodes 12 of apertures 11 through which toner T is not to be passed. A potential difference develops between those control electrodes 12 energized with these predetermined voltages and the toner-bearing roller 23, which is grounded to produce a 0 V thereat. Depending on the potential difference, an electric field develops in the aperture 11 to generate an electrostatic force for drawing the negatively charged toner T toward a higher electric potential.

For example, apertures 11 of control electrodes 12 applied with a positive 30 V voltage receive an electrostatic force in the direction of the control electrodes 12. Therefore, toner T born on the toner-bearing roller 23 is drawn from the surface of the toner-bearing roller 23, through the apertures 11, and toward the side of the aperture electrode body 10 where the corresponding control electrodes 12 are located. An electric field further develops due to a potential difference between the back-electrode roller 32, which is applied with a positive 500 V voltage by the DC power source E1, and the control electrodes 12. Toner T that was drawn through the apertures 11 and toward the control electrodes 12 of the aperture electrode body 10 therefore receives an electrostatic force from this electric field and is drawn towards the back-electrode roller 32 of the higher potential. The toner T clings to and accumulates on the belt 31 which is disposed between the aperture electrode body 10 and the back-electrode roller 32.

On the other hand, when control electrodes 12 are applied with a negative 30 V voltage, electric potential will become higher at the toner-bearing roller 23 than at the corresponding apertures 11. In this case, the toner T receives an electrostatic force in the direction of the toner-bearing roller 23. For this reason, toner T is maintained on the toner-bearing roller 23 and does not fall from the toner-bearing roller 23.

As a result, one line's worth of toner image is formed with pixels at portions of the belt 31 that oppose apertures 11 which have positive 30 V voltage applied to their control electrodes 12. No pixels are formed at portions that oppose apertures 11 which have negative 30 V voltage applied to their control electrodes 12.

When one line's worth of toner image is formed on the belt 31, rotation of the back-electrode roller 32 and the thermal roller 33 transports the belt 31 one pixel's distance in the direction perpendicular to the row of apertures 11. The above-described processes for forming one line's worth of toner image are repeated to form one screen's worth of toner image on the belt 31.

Transport of the belt 31 brings the portion of the belt 31 on which the toner image is formed to the position (transfer position TP) where the pressure roller 34 and the thermal roller 33, the pressure roller 34 and the thermal roller 33 forming a transfer device at the transfer position TP, are in contact.

The pressure roller 34 transports the image recording medium P in a predetermined direction in synchronization with the speed of the belt 31, while pressing the image recording medium P to the belt 31. This transfers the toner image from the belt 31 to the surface of the image recording medium P. The belt 31 which has been heated by the thermal roller 33 to the predetermined temperature, heats up the image recording medium P, thereby fixing the transferred toner image to the image recording medium P. This completes one series of processes for forming the image on an image recording medium P.

As described above, the belt 31 in the image forming device 1 of the present embodiment is made from a resin formed in a belt shape. The belt 31 is mounted to and stretched around the back-electrode roller 32 and the thermal roller 33. Because the gap separating the belt 31 from the aperture electrode body 10 is maintained at a fixed distance, damage to the aperture electrode body 10 can be prevented without fear of the aperture electrode body 10 touching other objects.

The belt 31 allows positioning the image recording medium P at a position a distance away from the aperture electrode body 10. Therefore, foreign matter that happens to separate from the image recording medium P will not cling to the aperture electrode body 10. Accordingly, the toner can be stably controlled so that images can be formed with consistently high quality.

Both transfer of the toner image from the intermediate recording medium 31 to the image recording medium P and fixation of the toner image to the image recording medium P are performed at the same time by pressing the heated belt 31 against the image recording medium P. Less power is consumed compared to conventional devices which perform transfer and fixation in separate operations. Because the belt 31, which is made from a resin film, has a small thermal capacity, it can be heated to the predetermined temperature rapidly and with only a small amount of energy. Therefore, power consumption can be reduced.

According to the present invention, the intermediate recording medium 31 is formed in a belt shape that is mounted on and applied with tension by the back-electrode roller 32 and the thermal roller 33, the position of the thermal roller 33 can be changed with comparative freedom. Accordingly, space can be more effectively utilized and the device can be made in a more compact shape.

Figure 5:
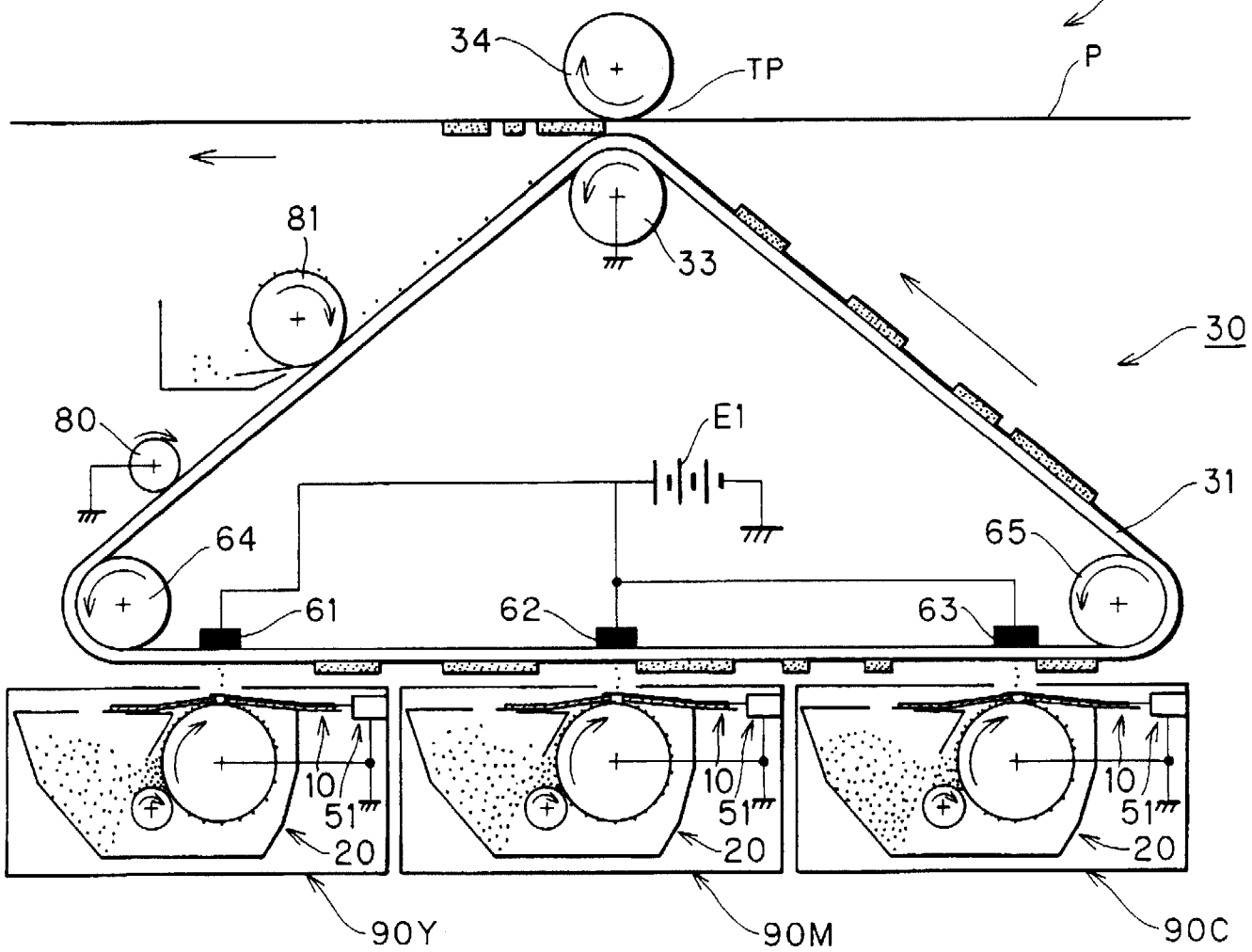
FIG. 5 is a modification of the first embodiment to a full-color image forming device.

The above-described monochromatic image forming device 1 can be modified to an image forming device for forming multi-color or full-color images. FIG. 5 is an explanatory diagram schematically showing a modification of the embodiment to a full-color image forming device.

The full-color image forming device 1 includes three process units 90Y, 90M, and 90C for forming yellow, magenta, and cyan components respectively of a full-color toner image according to an image signal inputted from an external source. Each of the process units 90Y, 90M, and 90C has a toner supply unit 20, an aperture electrode body 10, and a control voltage application circuit 51 which have the same configurations as described above and which also operate in the same manner as described above. The process unit 90Y stores yellow toner for forming the yellow component of toner images. The process unit 90M stores magenta toner for forming the magenta component of toner images. The process unit 90C stores cyan toner for forming the cyan component of toner images. The three process units 90Y thorough 90C are provided in parallel with the direction which the recording sheet P is transported.

In the intermediate recording mechanism 30, the belt 31 is stretched around a pair of tension rollers 64 and 65 and the heat roller 33 (in this embodiment the rollers 33, 64, 65 form the first transporting mechanism). The pair of tension rollers 64 and 65 maintain the belt 31 in opposition to, and separated by a predetermined gap (for example 0.5 mm) from, the aperture electrode body 10 of each of the process units 90Y, 90M, and 90C and applies tension to the belt 31 while transporting it in a predetermined direction. Thus, the belt 31 is aligned with the three process units 90M through 90C. The heat roller 33 is provided at a position in contact with the transport path of the image recording medium P. The heat roller 33 has an internal heater, such as a halogen heater, for heating the belt 31 to the predetermined temperature. The heat roller 33 is electrically grounded and also operates as a residual-charge unit for removing charge from the inner surface of the belt 31.

Back electrodes 61, 62, and 63 are positioned in opposition to the process units 90Y, 90M, and 90C, respectively. The belt 31 is disposed to pass between back electrodes 61, 62 and 63 and their respective opposing process units 90Y, 90M, and 90C. A DC power source E1 is provided for applying a predetermined high voltage (for example, 500 V) to each of the back electrodes 61, 62, and 63. The color toner TY, TM, and TC is controlled by the process units 90Y through 90C, serially and in synchronization, to output to cling to predetermined regions of the belt 31, thereby forming a color image.

The pressure roller 34 provided for transporting the image recording medium P at a predetermined speed while pressing it against the belt 31 is disposed at a position opposing the heat roller 33. The belt 31 is disposed to pass between the pressure roller 34 and the heat roller 33. A roller-shaped remover 81 for removing, after the toner image is transferred to the image recording medium P, residual toner from the surface of the belt 31 is provided in contact with the surface of the belt 31 on which the toner image is formed. In the same manner, a roller-shaped residual-charge device 80 for removing residual charge from the belt 31 is provided in contact with the surface of the belt 31 on which the toner image is formed.

With the above-described structure, the full-color image forming device of FIG. 5 operates as described below. A full-color image signal inputted from an external source is divided into signals for each of the three colors and then inputted to the control voltage application circuit 51 of the corresponding process unit 90Y, 90M, and 90C. Toner that passes through apertures in the aperture electrode body 10 of each of the process units 90Y, 90M, and 90C is drawn toward the corresponding back electrode 61, 62, and 63. The toner clings to and accumulates on the belt 31, thereby forming a toner image. Accordingly, the yellow component, magenta component, and cyan component of a toner image forms on the belt 31 when the belt 31 passes by the process unit 90Y, 90M, and 90C, respectively. In other words, a full-color image is formed on the belt 31 when the belt 31 passes by the process units 90Y, 90M, and 90C.

The heat roller 33 and the tension rollers 64 and 65 are driven by a drive circuit (not shown in the drawings) to rotate so that the belt 31 with the full-color image formed thereon is transported to the position where the pressure roller 33 and the heat roller 34 are disposed in opposition. The pressure roller 34 transports the image recording medium P in synchronization with the speed of the belt 31. The pressure roller 34 presses the image recording medium P against the belt 31, thereby transferring, to the image recording medium P, the full-color toner image formed on the belt 31. The belt 31, which has been heated by the heat roller 33, heats the image recording medium P, thereby thermally fixing the transferred toner image to the image recording medium P. In this way a full-color image can be recorded on the image recording medium P.

After the toner image is transferred to the image recording medium P, the remover 81 removes dust and residual toner from the toner forming surface. Then the residual-charge device 80 removes static electricity from the belt 31. Afterward, the belt 31 is again transported between the process units 90Y, 90M, and 90C and respective back electrodes 61, 62, and 63 to form a new toner image.

Because residual toner and dust is removed from the belt 31 each time a toner image is transferred as described above, the full-color image forming device can constantly produce good-quality images. The other effects obtained by the monochromatic image forming device of FIG. 1 are also obtained by the full-color image forming device of FIG. 5.

The full-color image was described as being transferred to the image recording medium P after being formed on the belt 31. However, three monochrome toner images can be formed separately on the belt 31, and then transferred to the image recording medium P, one after the other in series to form a full-color image on the image recording medium P.

An additional process unit for black toner can be provided in addition to the yellow, magenta, and cyan process units. This would allow forming images with a more vivid black color.

Although a negative 30 V voltage was described above as being applied to the control electrodes 12 at positions where no toner image is to be formed, these control electrodes 12 can be applied with a control voltage to give them an electric potential that is the same or less than that of the toner-bearing roller 23 (i.e., with 0 V or less). A control voltage application circuit for applying a control voltage of 0 V can be constructed with a simpler configuration.

Also, although an aperture electrode body 10 formed with a row of apertures 11 was described for controlling toner to form a toner image on the belt 31, the aperture electrode described in U.S. Pat. No. 5,036,341, that is formed two-dimensionally with apertures, could be used instead.

As described above, according to the first embodiment of the present invention, the toner supply unit supplies charged toner to the vicinity of the apertures. The control electrode drive circuit selectively applies, according to an image signal inputted from an external source, voltage between each control electrode and the toner supply unit to form a predetermined electric field on the toner supply unit in the vicinity and within corresponding apertures. This causes the toner supplied near the apertures to pass through the apertures by receiving electrostatic force from the electric field formed by the control electrode drive circuit.

The predetermined voltage is applied to the back electrode so that a predetermined electric field develops between the back electrode and the toner supply unit. For this reason, toner that passes through an aperture receives electrostatic force toward the back electrode. The toner moves toward and accumulates on the intermediate recording medium positioned between the back electrode and the aperture electrode, thereby forming a toner image. The intermediate recording medium with the toner image formed thereto is transported to the transport path for the image recording medium for the toner image.

When the toner image formed on the intermediate recording medium is transported to the transport path of the image recording medium, the image recording medium is caused to abut the intermediate recording medium so that the toner image on the intermediate recording medium is transferred to the image recording medium. Also, the intermediate recording medium heated by the heating unit heats the image recording medium and thermally fixes the toner image to the image recording medium.

Thermal fixation is therefore performed by heating the intermediate recording medium when the toner image is transferred from the intermediate recording medium to the image recording medium. Therefore, power consumption is reduced compared to conventional devices that consume power separately for both transfer and thermal fixation.

The intermediate recording medium is formed from a belt stretched between at least two rollers, one serving also as the back electrode and one serving also as the heating unit. The intermediate recording medium is formed from a belt so that the thermal capacity of the intermediate recording medium is reduced. With application of only a small amount of energy, the intermediate recording medium can be rapidly heated to a temperature required for thermal fixation. Accordingly, power consumption is further reduced compared to conventional image forming devices.

Because the intermediate recording medium is formed in a belt shape, it can be contained in a smaller space than can the conventional drum-shaped intermediate recording medium. Also, positioning of the rollers that serve as back electrode and as the heating unit can be performed with relative freedom. Therefore space can be efficiently utilized and the device can be made in a more compact size.

The image forming device can be provided with a plurality of aperture electrode bodies and toner supply units. If each toner supplying unit supplies a different colored toner to its aperture electrode body, a toner image with plural colors can be formed on the intermediate recording medium. By transferring this image to the image recording medium, a multi-color or full-color image can be formed on the image recording medium.

An image forming device of a second embodiment of the present invention will be described below with reference to FIGS. 6 through 11.

In the above-described first embodiment, the toner first clings to the intermediate recording medium 31 as a result of the relatively large electrostatic force generated by the back electrode 32. As the intermediate recording medium 31 moves, the toner moves away from the back electrode 32 and toward the transfer position TP. The toner, however, clings to the intermediate recording medium 31 by van der Waals forces and intermolecular forces among toner and image forces occurred between the toner and the intermediate recording medium. Accordingly, the toner can be reliably transported by the intermediate recording medium 31 to the transfer position TP, where the toner is transferred to the image recording medium P. The image forming device of the first embodiment can therefore form clean pixels and images. The second embodiment is for providing an improved device wherein the toner can be more reliably transported by the intermediate recording medium 31 to the transfer position TP.

Figure 6:
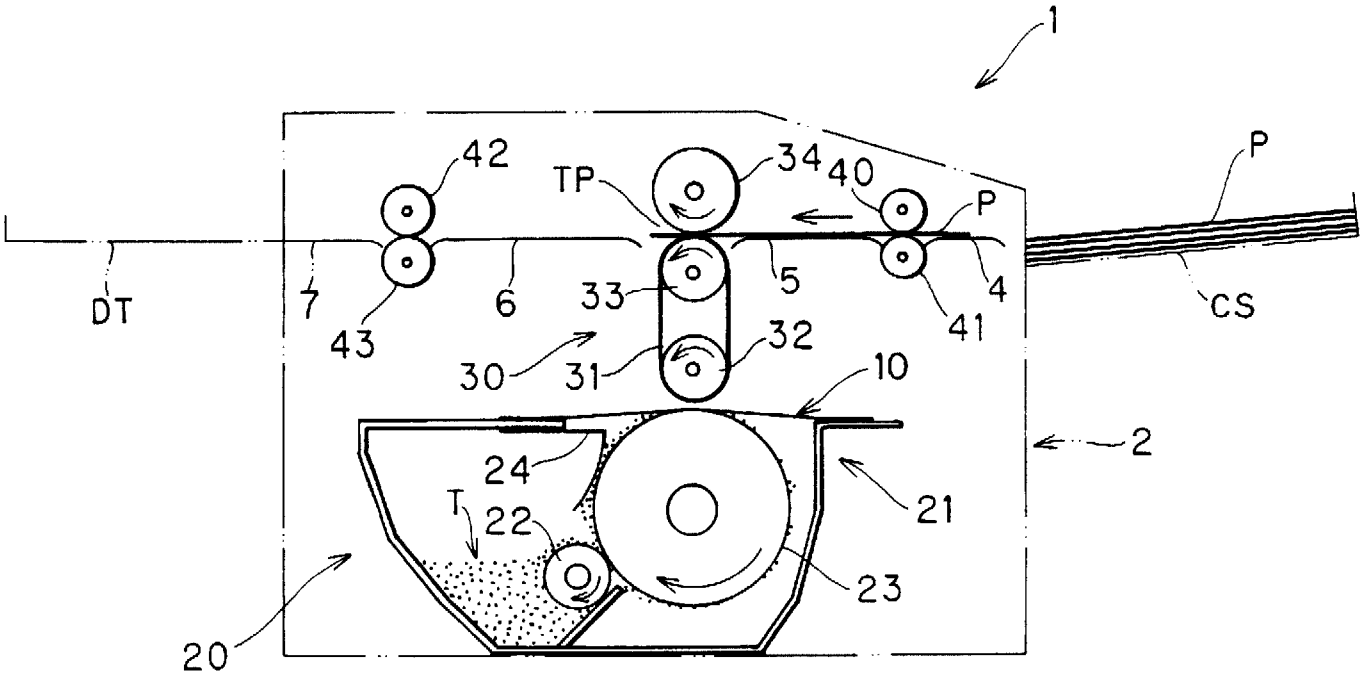
FIG. 6 is a schematic view of an image forming device of a second embodiment according to the present invention.

As shown in FIG. 6, an image forming device 1 of the second embodiment, which is structurally similar to that of the first embodiment, basically includes the toner supply unit 20; the aperture electrode body 10 attached to the toner supply unit 20; the intermediate recording mechanism 30; and the transport mechanism for transporting a recording sheet P. These components are housed in a frame 2. The transport mechanism includes guide plates 4, 5, 6, and 7 for supporting the transported recording sheet P and transport rollers 40, 41, 42, and 43 for transporting the recording sheet P. A sheet cassette CS holding a stack of recording sheets P is provided at the entrance end of the frame 2. A discharge tray DT for holding recorded and discharged recording sheets P is provided at the discharge end of the frame 2.

Figure 7:
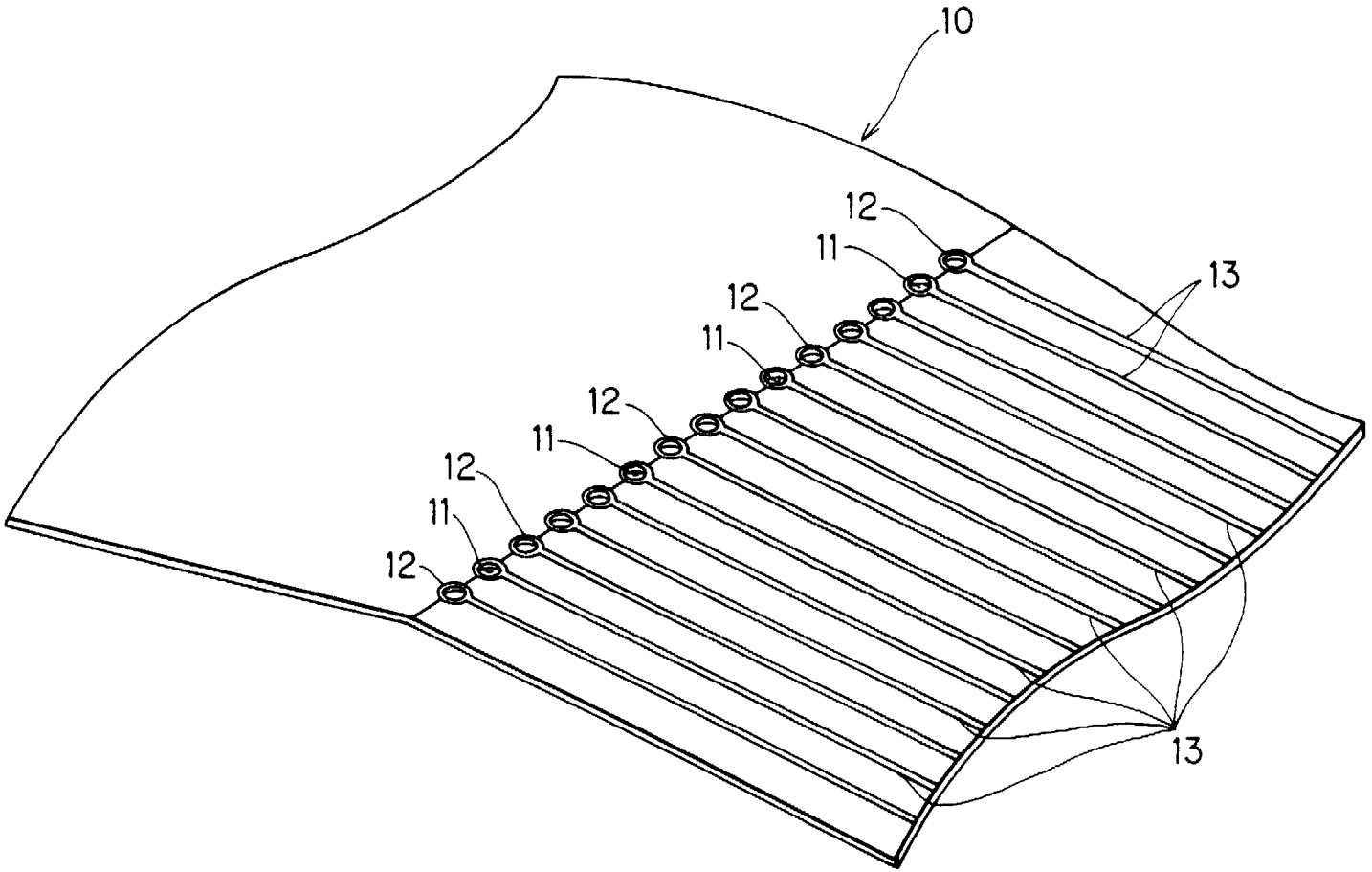
FIG. 7 is a perspective view of an aperture electrode body employed in the image forming device of FIG. 6.

As shown in FIG. 7, a row of circular apertures 11, having a diameter of about 60 to 65 microns and an inter-aperture spacing of about 127 microns, are formed along a substantially central position of the aperture electrode body 10 aligned in parallel with the toner-bearing roller 23. In this example, 1,600 apertures 11 form a row for a printing the width of an A4 size sheet. At the upper surface of the aperture electrode body 10, a ring-shaped control-electrode 12 is formed to the outer periphery of each of the apertures 11. Thin leads 13 are formed on the base of the electrode body 10 to extend from each of the control electrodes 12 to control lines L (see FIG. 11). A drive voltage of either a positive or negative 30 V voltage is supplied from the drive circuit 51 over the control lines L and the leads 13 to the control electrodes 12. Similarly to the first embodiment, the aperture electrode body 10 is bent into the shape of roof and is attached by its edges to the upper edge of the toner case 21 so as to cover the toner case 21 and contact the upper edge of the toner transport roller 23.

The power circuit E1 constantly applies a high-voltage of about 1 KV to the back electrode roller 32. This causes negatively charged toner T to be attracted in a direction toward the back electrode roller 32 with a large electrostatic force.

The drive circuit 51, on the other hand, is connected to the leads 13 of the aperture electrode body 10 via control lines L, which are formed from signal lines. Power circuit E2 for outputting positive or negative 30 V voltage and a control unit 50 such as a microcomputer are connected to the drive circuit 51. The control unit 50 outputs, to the drive circuit 51, a drive signal according to an image signal. Therefore, the drive circuit 51 switches between supplying, individually to each lead 13 via its control line L, positive and negative 30 V drive voltages according to the drive signal. Also, the toner-bearing roller 23 is constantly connected to ground.

Figure 8:
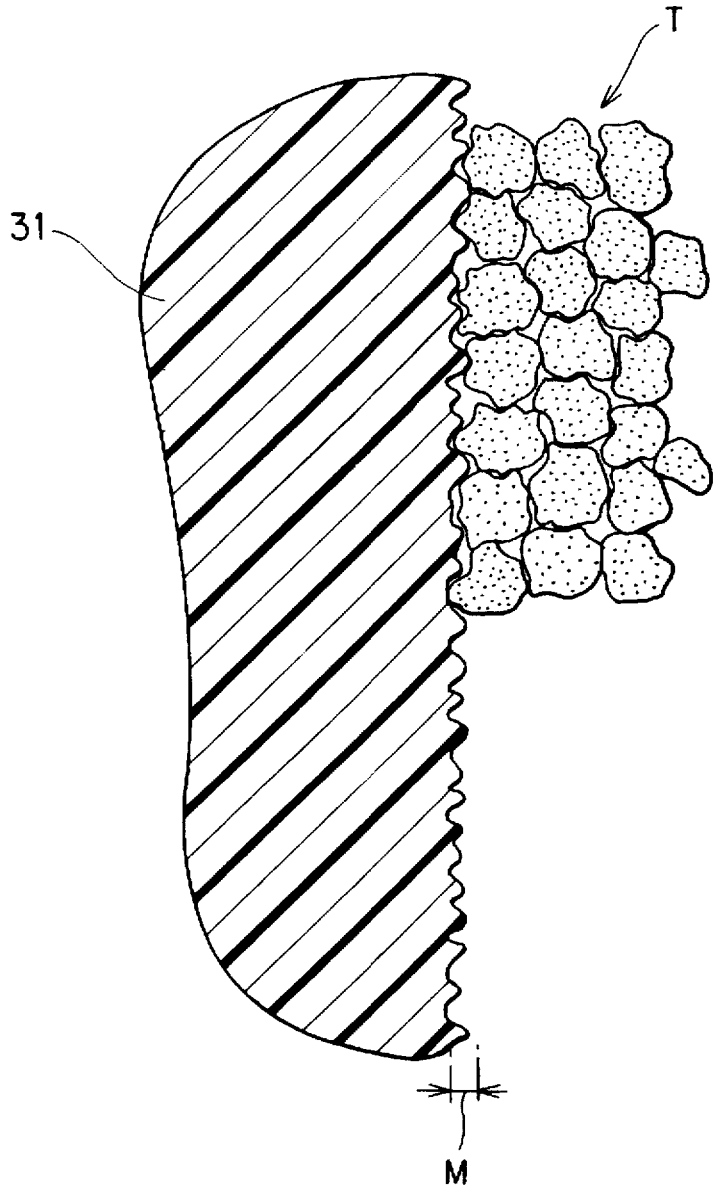
FIG. 8 is a partial sectional enlarged view of an intermediate recording medium to which toner clings in a layer.

Similarly to the first embodiment, the intermediate recording medium 31 vertically-disposed in the intermediate recording mechanism 30 is formed from a heat-resistance film into an endless belt having width substantially equal to the width of the recording sheet P. For example, the belt 31 could be made from an amide resin or a polyimide resin to a thickness of about 50 microns. According to the present embodiment, the surface of the belt 31 to which toner T clings is formed, by sandblasting for example, with a rough surface having maximum peaks M of about 3 to 4 microns, as shown in FIG. 8.

The particles of toner T housed in the toner case 21 generally have a spherical shape with diameter of about 10 microns and with many protrusions. The surface of the intermediate recording medium 31 to which toner clings is formed with a rough surface and so also has many indentations and protrusions. Not only protrusions of the toner particles contact the surface of the intermediate recording medium, but so do other surfaces of toner particles. This increases the surface area with which the toner particles cling to the surface of the intermediate recording medium 31. As a result, van der Waals forces and image forces acting on the toner and the intermediate recording medium 31 increase. Therefore, it is ensured that the toner will not fall off the intermediate recording medium 31 during transport to the transfer position TP. As a result, all the toner clinging to the intermediate recording medium 31 can be reliably transported to the transfer position and transferred there to the recording medium.

Figure 9:
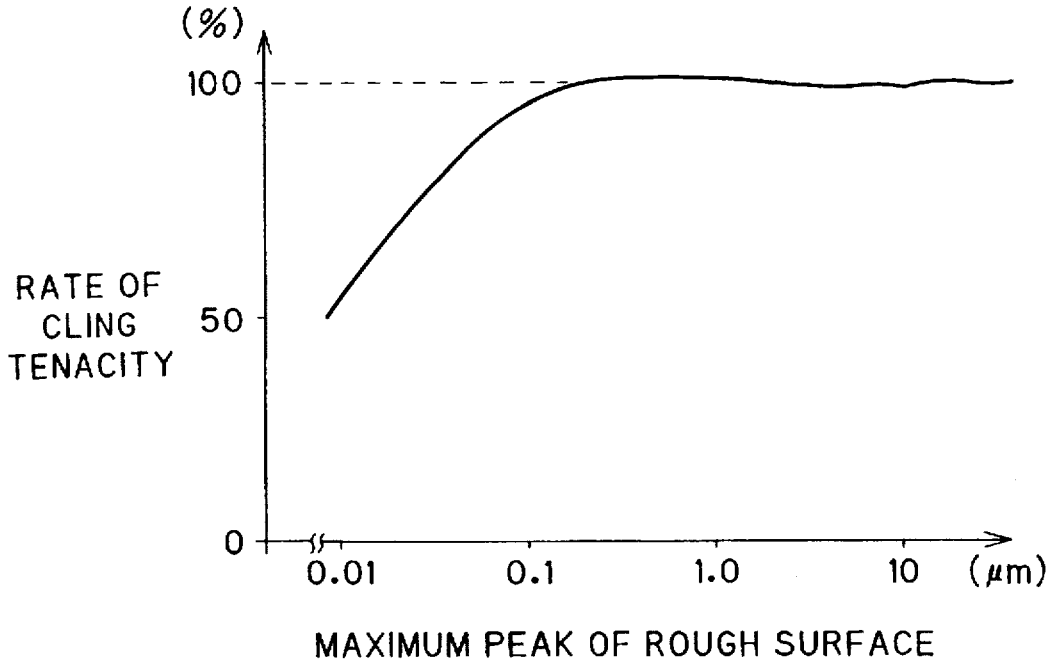
FIG. 9 is a graph showing the relationship between the roughness of the surface of the intermediate recording medium and the rate of clinging tenacity with which toner clings to the surface of the intermediate recording medium where toner has a diameter of about 10 μm.
Figure 10:
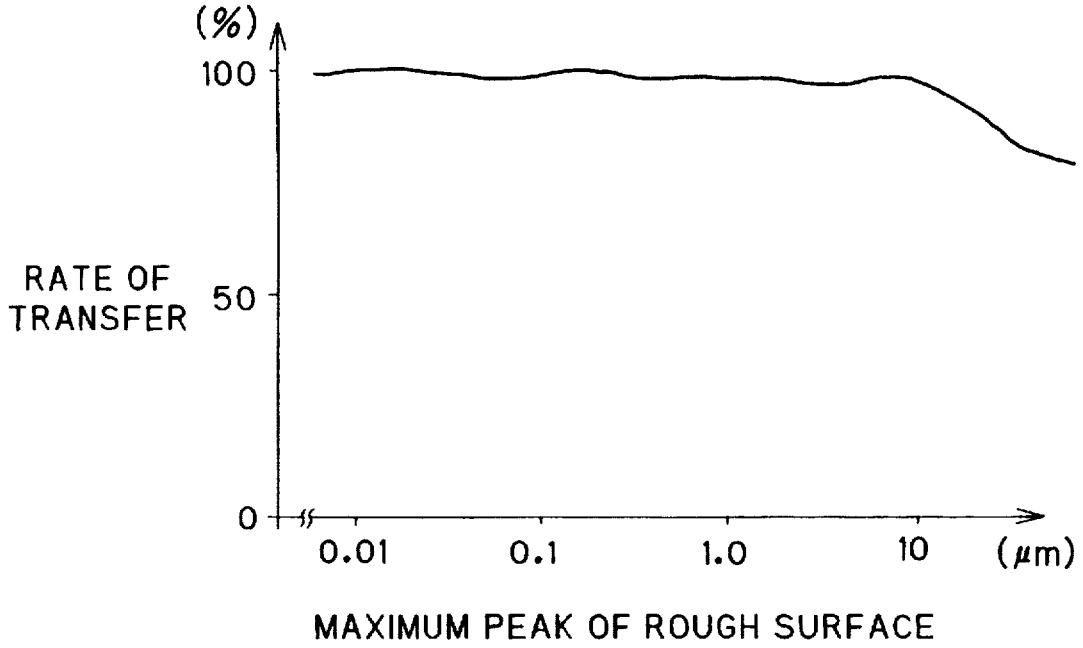
FIG. 10 is a graph showing the relationship between the roughness of the surface of the intermediate recording medium and the rate of transfer with which toner is transferred from the surface of the intermediate recording medium to an image recording medium where toner has a diameter of about 10 μm.

The interrelation between the clinging tenacity of the toner T in regards to the rough surface of the intermediate recording medium 31 is graphically represented in FIG. 9 where toner T has a diameter of about 10 μm. When the maximum peaks of the rough surface are about 0.1 microns high or higher, rate of clinging tenacity becomes substantially 100%. However, the rate at which toner clinging to the rough surface is transferred to the recording sheet P is, as shown in FIG. 10, substantially 100% when the maximum peaks of the rough surface are about 10 microns or less. Both the rate of clinging and the rate of transfer of the toner T becomes substantially 100% when maximum peaks of the rough surface are formed within the range of about 0.1 to 10 microns. Preferably, the maximum peaks are in an intermediate value of about 3 to 4 microns. In this example, therefore, the roughness is set to the intermediate value of about 3 to 4 microns.

The structures of components of the image forming device 1 of the present embodiment other than those as described above are the same as those of the first embodiment.

Figure 11:
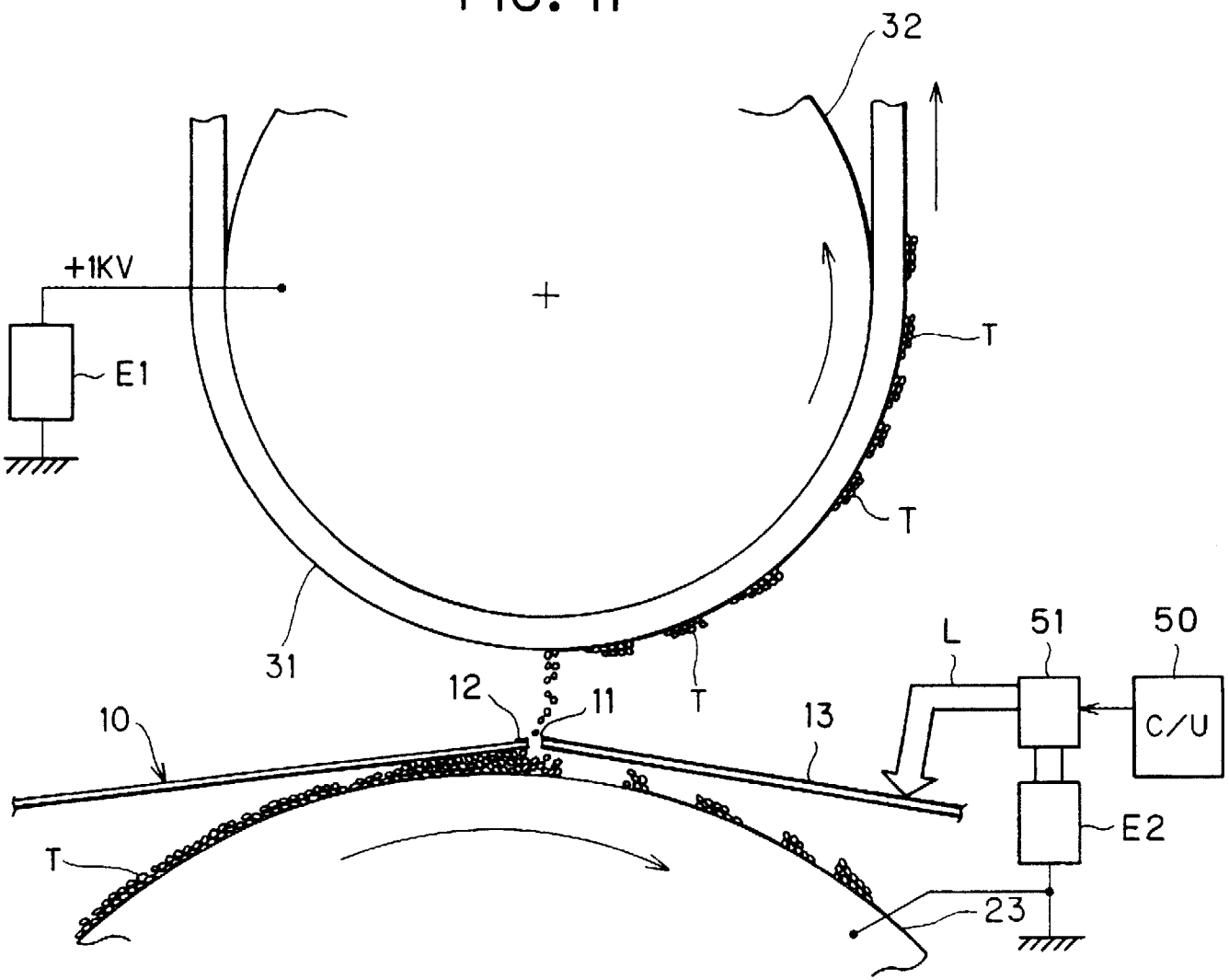
FIG. 11 is an enlarged side view showing how toner clings to an intermediate recording medium.

With the above-described structure, the image forming device 1 records an image by transferring, according to an image signal, toner T onto the recording sheet P. In more concrete terms, as shown in FIG. 11, when the drive circuit 51 applies, based on a drive signal received from the control unit 50, a positive 30 V voltage to the control electrodes 12, an electric field develops facing from the control electrodes 12 to the toner transport roller 23. The electric field causes the negatively charged toner T on the toner-bearing roller 23 to be attracted in the direction of the higher potential. The toner T is drawn from the surface of the toner-bearing roller 23, through the corresponding aperture 11, and toward the control electrodes 12. Further, electrostatic force, that is caused by the electric field which is generated between the back electrode roller 32 and the control electrodes 12 and which results from the high voltage of positive 1 KV applied to the back electrode roller 32, draws the toner T that passes through an aperture 11 towards the back electrode roller 32. The toner impinges on and clings to the belt 31. At this time, the toner T clings in a layered clump on the surface of the belt 31.

Movement of the belt 31 by rotation of the back electrode roller 32 in the predetermined direction transports the toner T clinging to the belt 31 to a transfer position TP where the belt 31 contacts the recording sheet P. Because the surface of the belt 31 to which the toner T clings is formed with a rough surface having maximum peaks M of about 3 to 4 microns, the surface of the belt to which toner clings is formed with a rough surface and so has many indentations and protrusions. Accordingly, not only protrusions of the toner particles contact the surface of the belt, but so do other surfaces of toner particles. This increases the surface area with which the toner particles cling to the surface of the belt. As a result, van der Waals forces and image forces acting on the toner and the belt increase, thus boosting clinging tenacity of the toner T. Therefore, even if the electrostatic forces received by the toner from the back electrode roller 32 weaken, none of the toner clinging in clumps will fall off the belt.

The first layer (lowermost layer) of approximately 10 micron diameter toner particles clinging directly to the surface of the intermediate recording medium 31 fit incompletely into the indentations of the uneven surface formed to the intermediate recording medium 31. Therefore, the toner T transported by the intermediate recording medium 31 can be reliably transferred to the recording sheet P at the transfer position TP. At the same time, the toner T is fixed to the recording sheet P by heat from the heat roller 33, thereby forming a clean image on the recording sheet P.

Although the above-described image forming device 1 is directed to a monochromatic image forming device, the above-described device can be modified into a full-color image forming device, similarly to the first embodiment. The modification of the present embodiment to the full-color image forming device 1 can be attained by forming the surface of the belt 31 of FIG. 5 rough in the above-described manner.

It is noted that though the toner having diameter of about 10 μm presents the characteristics of FIGS. 9 and 10, toner having diameter of 5 to 10 μm also presents the characteristics of FIGS. 9 and 10. Accordingly, when the toner T is formed from particles with diameter smaller than about 10 microns, for example, with diameter of about 7 or 5 microns, the rough surface of the belt 31 should preferably be formed with maximum peaks smaller than that set for the case of 10 microns but still in the range of 0.1 microns to 10 microns. Also, the present embodiment can be applied to various image recording devices that control clinging of toner T to recording sheet P using the aperture electrode body 10.

As described above, according to the second embodiment, the aperture electrode body 10 is formed with a plurality of apertures 11 in a row aligned in the widthwise direction of the image recording medium P and is formed with the electrode 12 for each of the plurality of apertures 11. The toner supply mechanism 21 supplies toner to apertures of the aperture electrode body. The toner control unit (50, 51) controls passage of toner through the apertures by individually controlling the voltage supplied to each of the electrodes of the aperture electrode body. The intermediate recording medium 31 is provided on an opposite side of the toner supply mechanism 21 with regards to the aperture electrode body 10. Toner clings to the intermediate recording medium. The intermediate recording medium is formed with a rough surface for boosting clinging tenacity with which toner clings to the intermediate recording medium. The drive unit drives rotation of the intermediate recording medium 31 in synchronization with transport of the recording medium P so that toner clinging to the intermediate recording medium is transported to the transfer position where toner is transferred to the image recording medium.

Because the surface of the intermediate recording medium to which toner clings is formed with a rough surface and so has many indentations and protrusions, not only protrusions of the toner particles contact the surface of the intermediate recording medium, but so do other surfaces of toner particles. This increases the surface area with which the toner particles cling to the surface of the intermediate recording medium. As a result, van der Waals forces and image forces acting on the toner and the intermediate recording medium increase. Therefore, it is ensured that the toner will not fall off the intermediate recording medium during transport to the transfer position. As a result, all the toner clinging to the intermediate recording medium can be reliably transported to the transfer position and transferred to the recording medium.

The maximum peaks of the unevenness at the surface of the intermediate recording medium are set within the range of from 0.1 micron to 10.0 microns. Therefore toner with diameter of about 10 microns will not completely fit into the depressions of the unevenness formed on the rough surface. Therefore, toner transported on the intermediate recording medium will be reliably transferred to the image recording medium.

Next, an image forming device of a third embodiment will be described with reference to FIGS. 12–18.

In the second embodiment, in order to improve the tenacity with which toner clings to the belt 31, a rough surface is formed to the surface of the belt 31. The third embodiment provides another method of increasing the tenacity with which toner clings to the belt 31.

Figure 12:
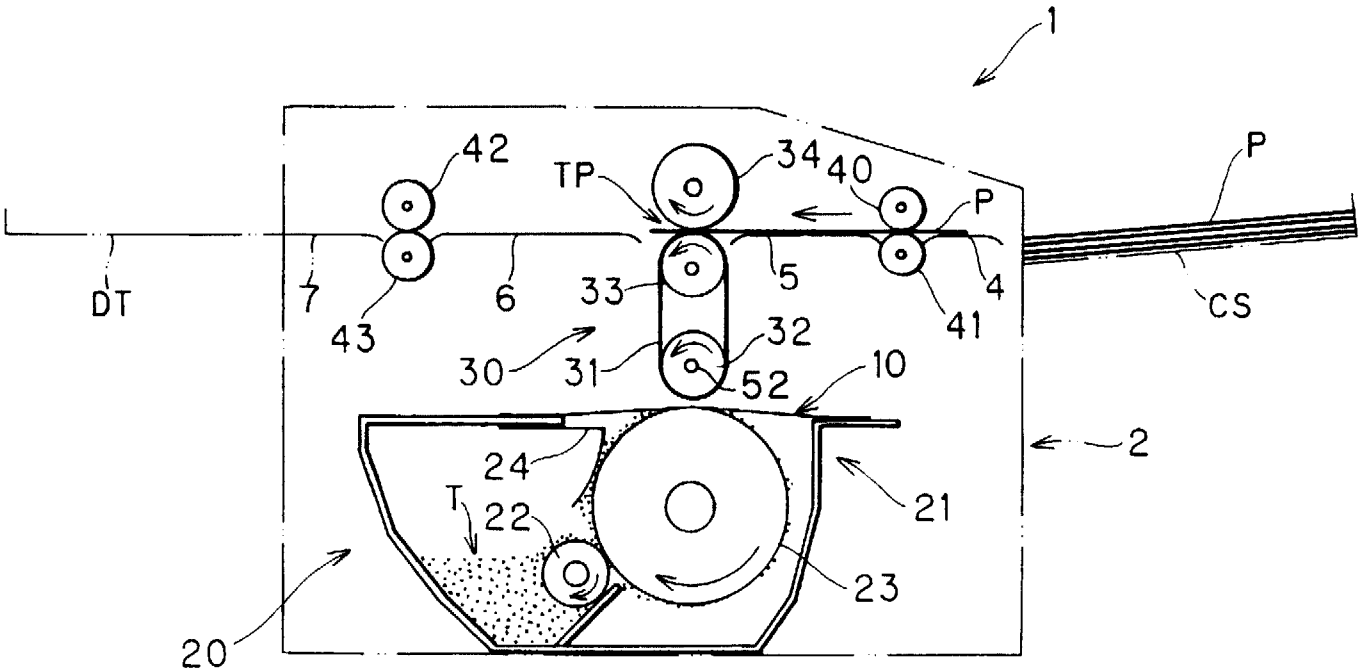
FIG. 12 is a schematic view of an image forming device of a third embodiment according to the present invention.
Figure 13:
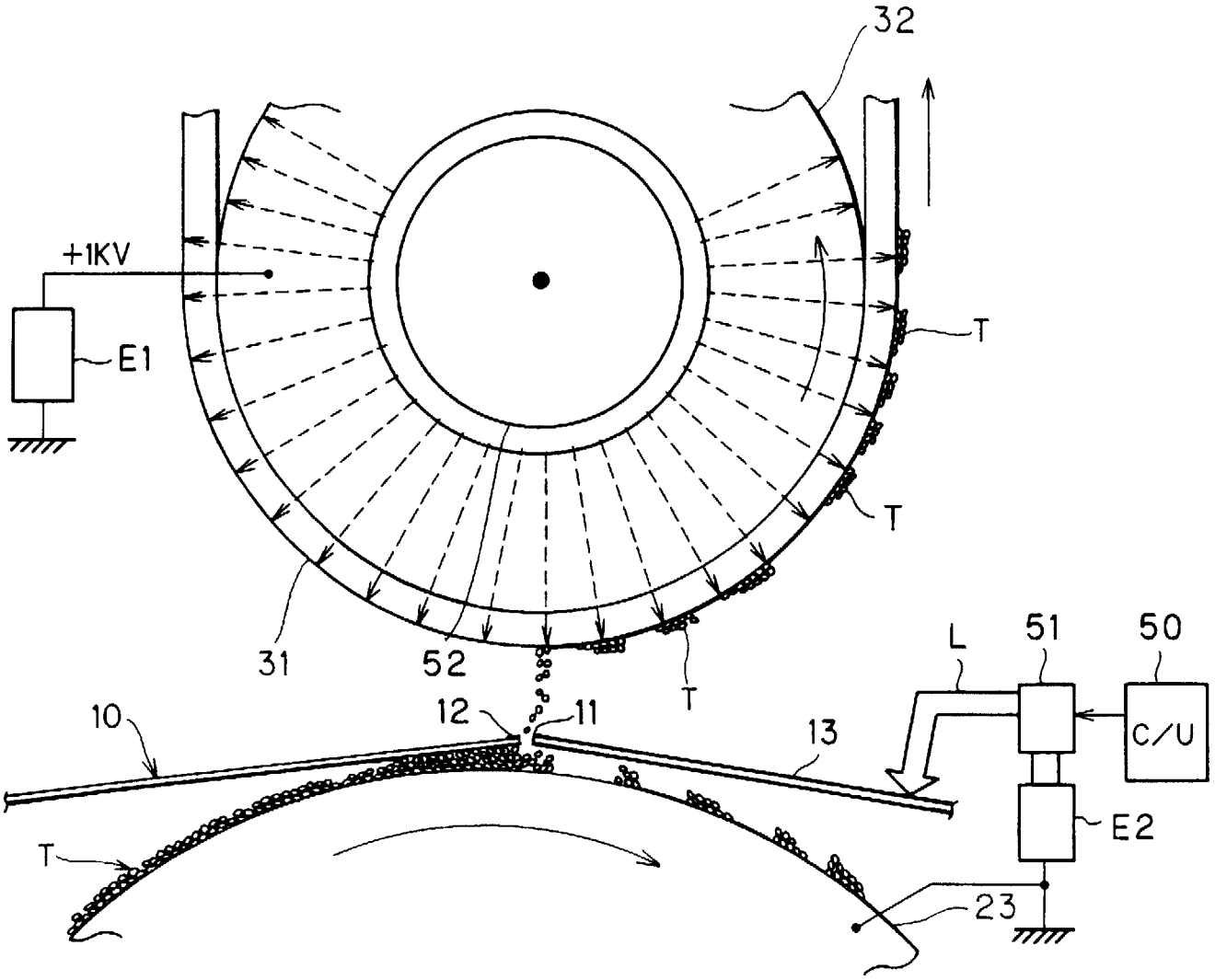
FIG. 13 is an enlarged side view showing how toner clings to an intermediate recording medium.

According to the present embodiment, as shown in FIGS. 12 and 13, the back electrode roller 32 is formed from a hollow roller, and a halogen lamp 52 having a length substantially equal to the length of the back electrode roller 32 is provided to the hollow center of the back electrode roller 32. A power circuit (not shown in the drawings) is provided for supplying a drive voltage to the halogen lamp 52. The halogen lamp 52 heats upon reception of the drive voltage. As indicated by the broken line in FIG. 13, the halogen lamp 52 heats the back electrode roller 32, and the belt 31 in contact with the back electrode roller 32, to, for example, 80° C., and constitutes a preheater. Heating the belt 31, and as a result the toner T clinging thereto, to about 80° C., the toner T softens so that it clings to the belt 31 with greater tenacity. This prevents the toner T from dropping from the surface of the belt 31. The structures of components of the image forming device 1 of the present embodiment other than those as described above are the same as those of the second embodiment, except that the belt 31 of this embodiment is not formed with the rough surface.

Figure 14:
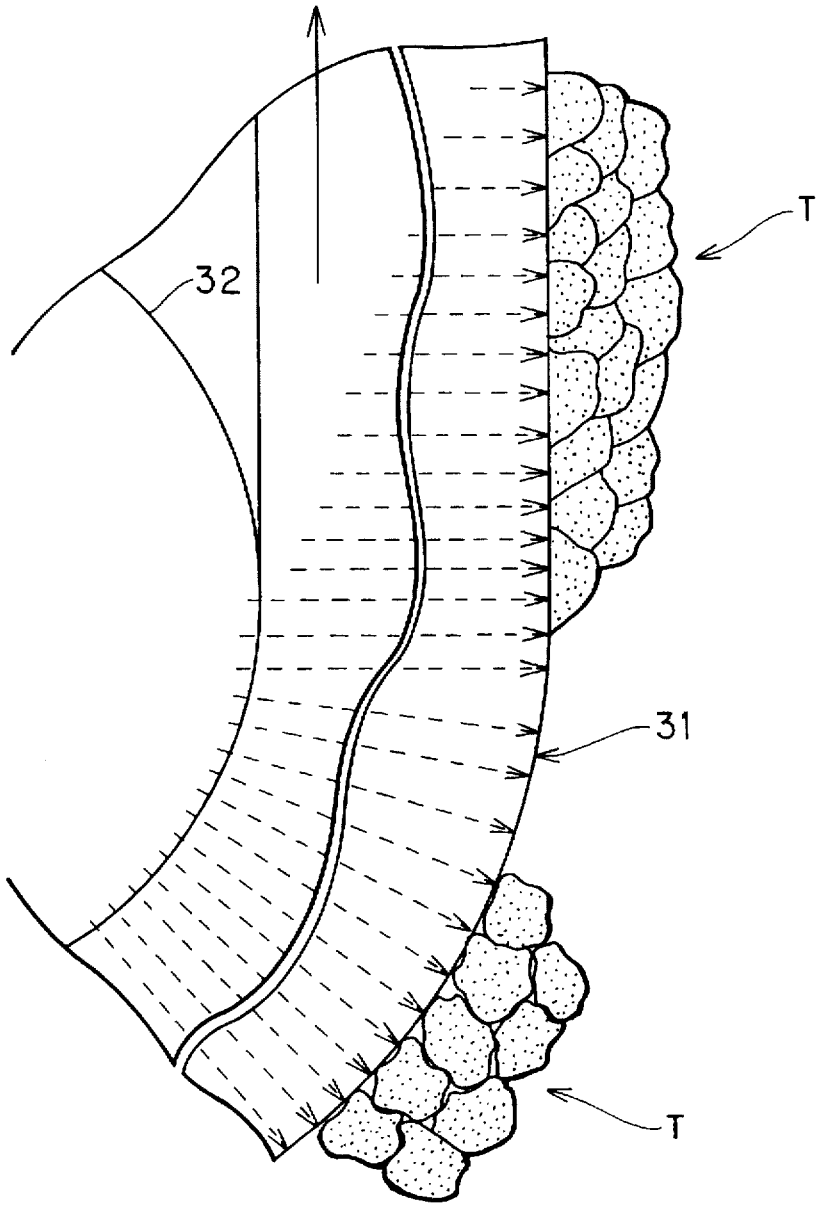
FIG. 14 is a partial sectional enlarged view of the intermediate recording medium to which toner clings in a layer.

With the above-described structure, rotation of the back electrode roller 32 in the predetermined direction advances the belt 31, so that the toner T clinging to the belt 31 is transported to the transfer position TP at the underside of the image recording medium P. As shown in FIGS. 13 and 14, and as described above, the belt 31 is heated by the back electrode roller 32 to about 80° C. The 80° C. temperature softens the layer of toner T clinging to the belt 31. The softened integral mass of toner T clings with greater tenacity to, and so will not fall from, the belt 31. After the softened toner is transported to the transfer position TP by the belt 31, it is simultaneously transferred reliably to the image recording medium P and fixed to the image recording medium P by heat from the heat roller 33. That is, the halogen lamp in the heat roller 33 heats to about 130° C. when supplied by a drive voltage from the power circuit (not shown in the drawings), similarly to the first and second embodiments. The toner T transferred to the image recording medium P is melted and then fixed to the image recording medium P. As a result, a clean image is formed on the image recording medium P.

Figure 15:
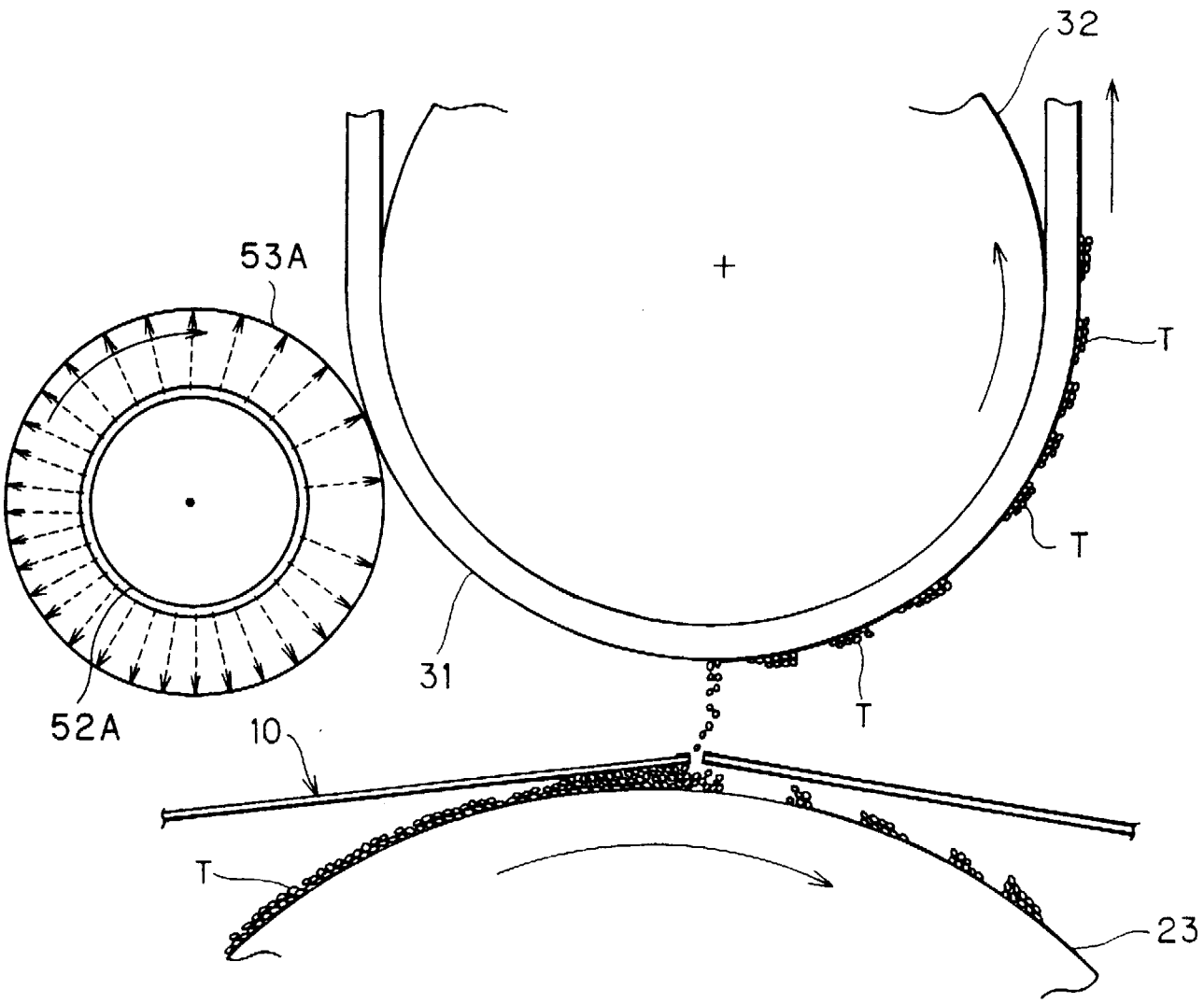
FIG. 15 shows a modification of the third embodiment where a heating roller is provided at a position upstream from where toner clings to the intermediate recording medium.

As shown in FIG. 15, a rotation roller 53A can be provided in pressing contact with the belt 31 at a position upstream from where the toner T from the aperture electrode body 10 clings to the belt 31. A halogen lamp 52A for heating the belt 31, thereby heating the toner T clinging to the belt 31 can be provided internally to the rotation roller 53A instead of to the back electrode roller 32. In this example, heat from the halogen lamp 52A heats the rotation roller 53A, forming a preheater as shown by the arrowed broken lines in FIG. 15. This causes the rotation roller 53A to heat the belt 31 to about 80° C.

Figure 16:
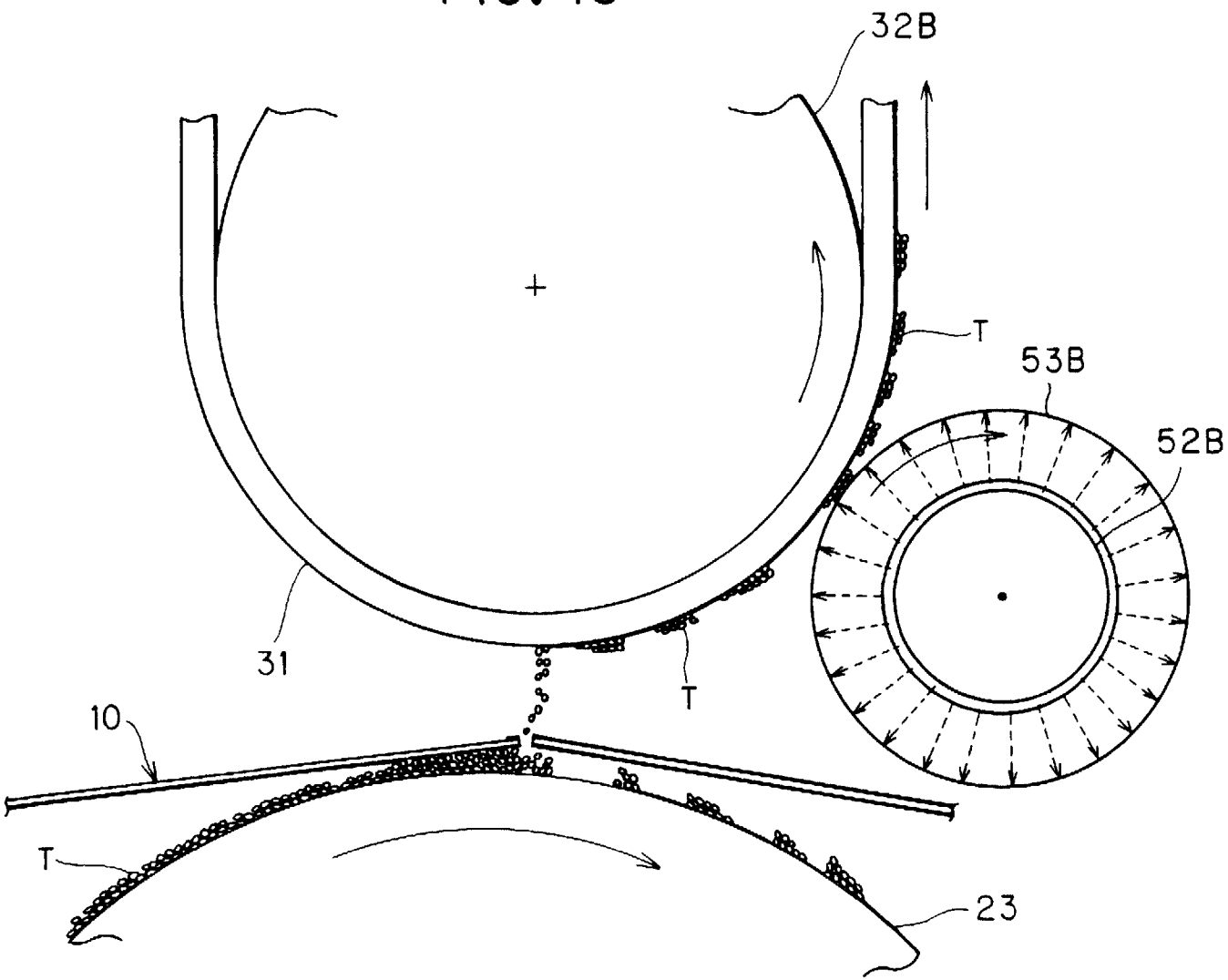
FIG. 16 shows another modification where a heating roller is provided at a position downstream from where toner clings to the intermediate recording medium.

Similarly, as shown in FIG. 16, a rotation roller 53B can be provided in pressing contact with the belt 31 at a position downstream from where the toner T from the aperture electrode body 10 clings to the belt 31. A halogen lamp 52B for heating the roller 53B, forming a preheater thereby heating the toner T clinging to the belt 31 can be provided internally to the rotation roller 53B. The roller 53B can therefore directly heat to about 80° C. the toner T clinging to the belt 31 and contacted with the roller 53B.

Figure 17:
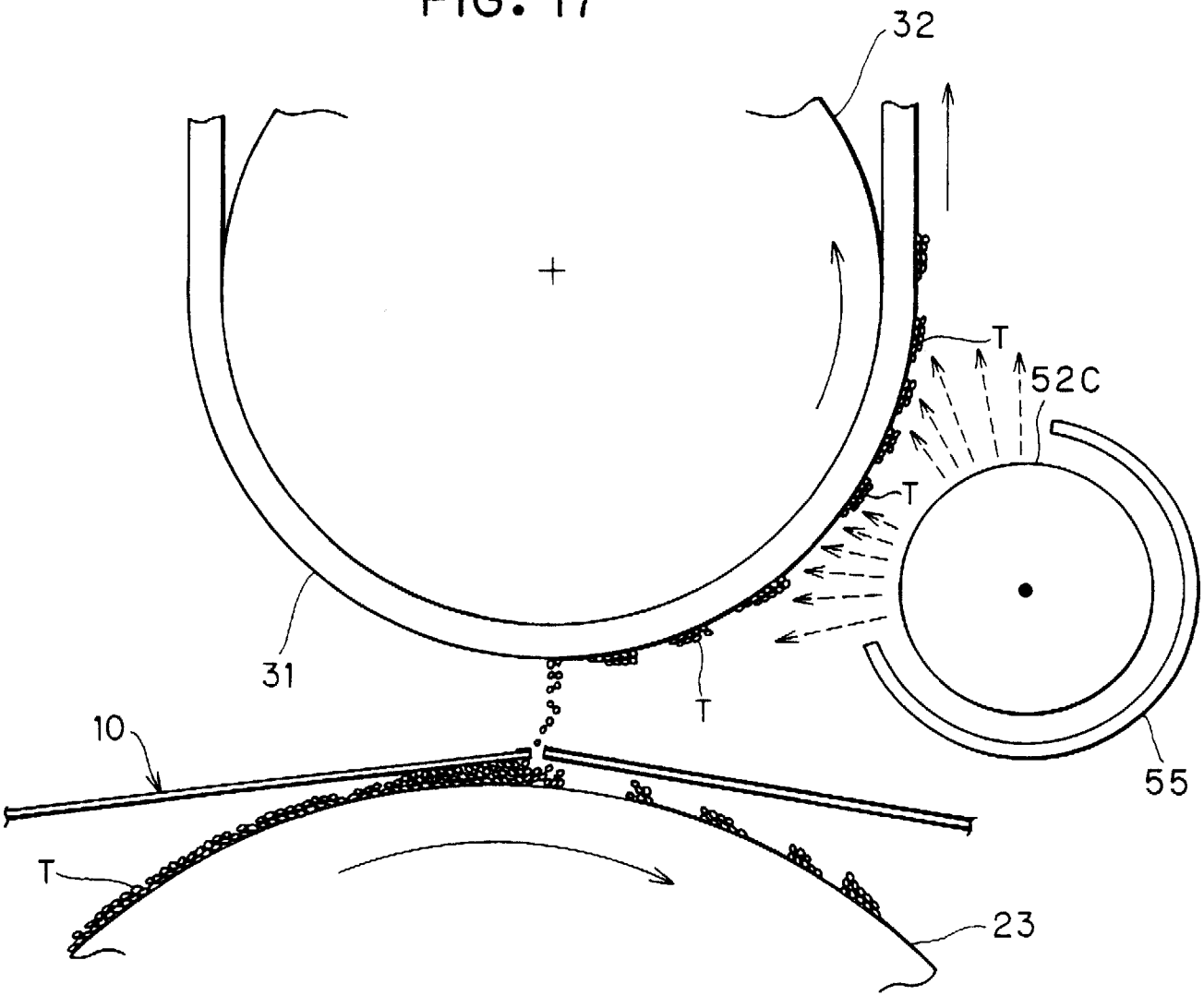
FIG. 17 shows still another modification where a halogen lamp is provided at a position downstream from where toner clings to the intermediate recording medium.

Further, as shown in FIG. 17, a halogen lamp 52C can be provided in opposition to the belt 31 at a position downstream from where the toner T clings to the belt 31. A reflection plate 55 for reflecting heat of the halogen lamp 52C, and forming a preheater, toward the belt 31 can be provided around the halogen lamp 52C. The halogen lamp 52C directly heats and softens the toner T clinging to the belt 31. Because the halogen lamp 52C directly heats and softens the toner T, the toner T is efficiently softened so that the halogen lamp 52C need be provided with only a small heating capacity.

It should be noted that as the size of toner decreases, the fill rate of toner in each pixel increases, and accordingly the thermal efficiency increases. Therefore, when the toner particles are smaller than 10 μm in diameter, for example, are 5 to 7 μm in diameter, temperature should preferably be adjusted to be lower than 80° C. for providing heat to appropriately soften the smaller diameter toner. Types and configuration of those components (52, 52A–52C, 53A–53B, 55) may be altered as appropriate for providing heat to appropriately soften the smaller diameter toner. Also, other types of heating element can be used instead of the halogen lamp.

Figure 18:
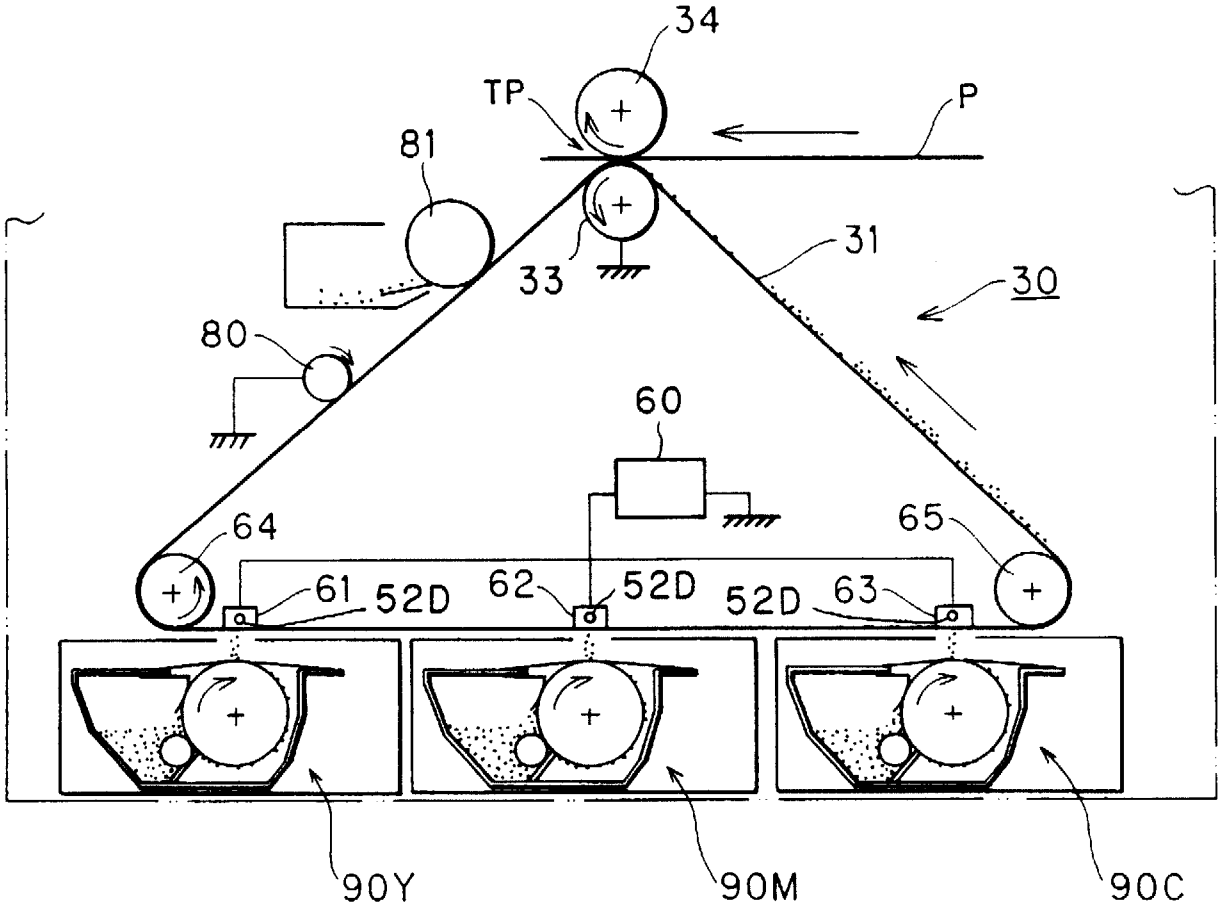
FIG. 18 is a modification of the third embodiment to a full-color image forming device.

Although the above description is directed to a monochromatic image forming device 1, the present embodiment can be modified into a full-color image forming device. FIG. 18 shows a full-color image forming device 1 of the present embodiment. The device is the same as that of the first embodiment shown in FIG. 5, except that a halogen lamp 52D is provided in each of the back electrodes 61, 62, and 63 and that a drive circuit 60 is provided both for supplying the high voltage to the electrodes 61–63 and for driving the halogen lamps 52D.

As described above, according to the present embodiment, the aperture electrode body 10 is formed with the plurality of apertures in a row aligned in the widthwise direction of the image recording medium P and is formed with the electrode 12 for each of the plurality of apertures. The toner supply mechanism 20 supplies toner to apertures 11 of the aperture electrode body. The toner control unit (50, 51) controls passage of toner through the apertures by individually controlling voltage supplied to each of the electrodes of the aperture electrode body. The intermediate recording medium 31 is provided on an opposite side of the toner supply mechanism with regards to the aperture electrode body 10. Toner clings to the intermediate recording medium 31. The preheating unit (52, 52A, 52B, 52C, or 52D) increases tenacity at which toner clings to the intermediate recording medium 31 by heating and softening the toner. The drive unit drives rotation of the intermediate recording medium in synchronization with transport of the recording medium so that toner clinging to the intermediate recording medium is transported to the transfer position TP where toner is transferred to the image recording medium.

Thus, the layer of toner clinging to the intermediate recording medium is softened by heat from the preheating unit (52, 52A, 52B, 52C, or 52D) so that particles of toner in the toner layer cling to each other and also the tenacity with which the toner layer clings to the intermediate recording medium increases. Because particles in toner layers integrally mass together and tenaciously cling to the intermediate recording medium, the toner will not fall off the intermediate recording medium during transport to the transfer position TP. All of the toner clinging to the intermediate recording medium will be reliably transported to, and then transferred to the image recording medium at, the transfer position.

Because the toner clinging to the intermediate recording medium is thus softened by being heated, all of the toner layer clings tenaciously and as an integral unit to the intermediate recording medium. Therefore, all of the toner clinging to the intermediate recording medium can be reliably transported to the transfer position TP and transferred there to the recording medium, thereby promoting formation of clean images.

Because the heating unit (52, 52A, 52D) heats the toner via the intermediate recording medium 31, the intermediate recording medium with the toner clinging thereto is heated. This greatly improves tenacity with which toner clings to the intermediate recording medium 31 and also improves freedom with which the heating units for heating the intermediate recording medium 31 can be positioned in the image forming device.

Because the heating unit (52B, 52C) directly heats the toner clinging to the intermediate recording medium, the toner can be softened and caused to cling to the intermediate recording medium with greater efficiency. Therefore, the heating capacity of the heating unit can be reduced.

It is noted that the present embodiment can be applied to various image recording devices that control clinging of toner T to recording sheet P using the aperture electrode body 10.

Next, will be described an image forming device according to a fourth embodiment of the present invention with reference to FIGS. 19 through 25.

Though the heat roller 33 is provided with the halogen lamp to heat the belt 31 in the above-described embodiments, the present embodiment provides another method of heating the belt 31.

Figure 19:
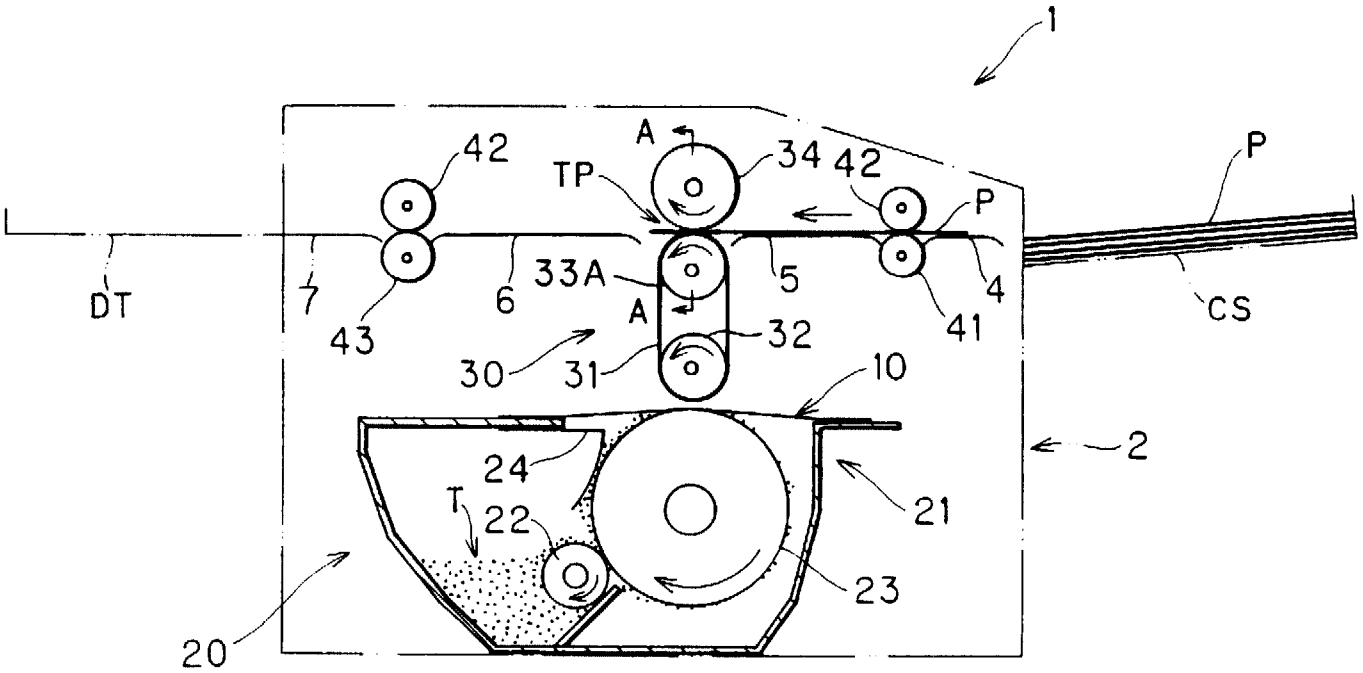
FIG. 19 is a schematic view of an image forming device of a fourth embodiment according to the present invention.
Figure 20:
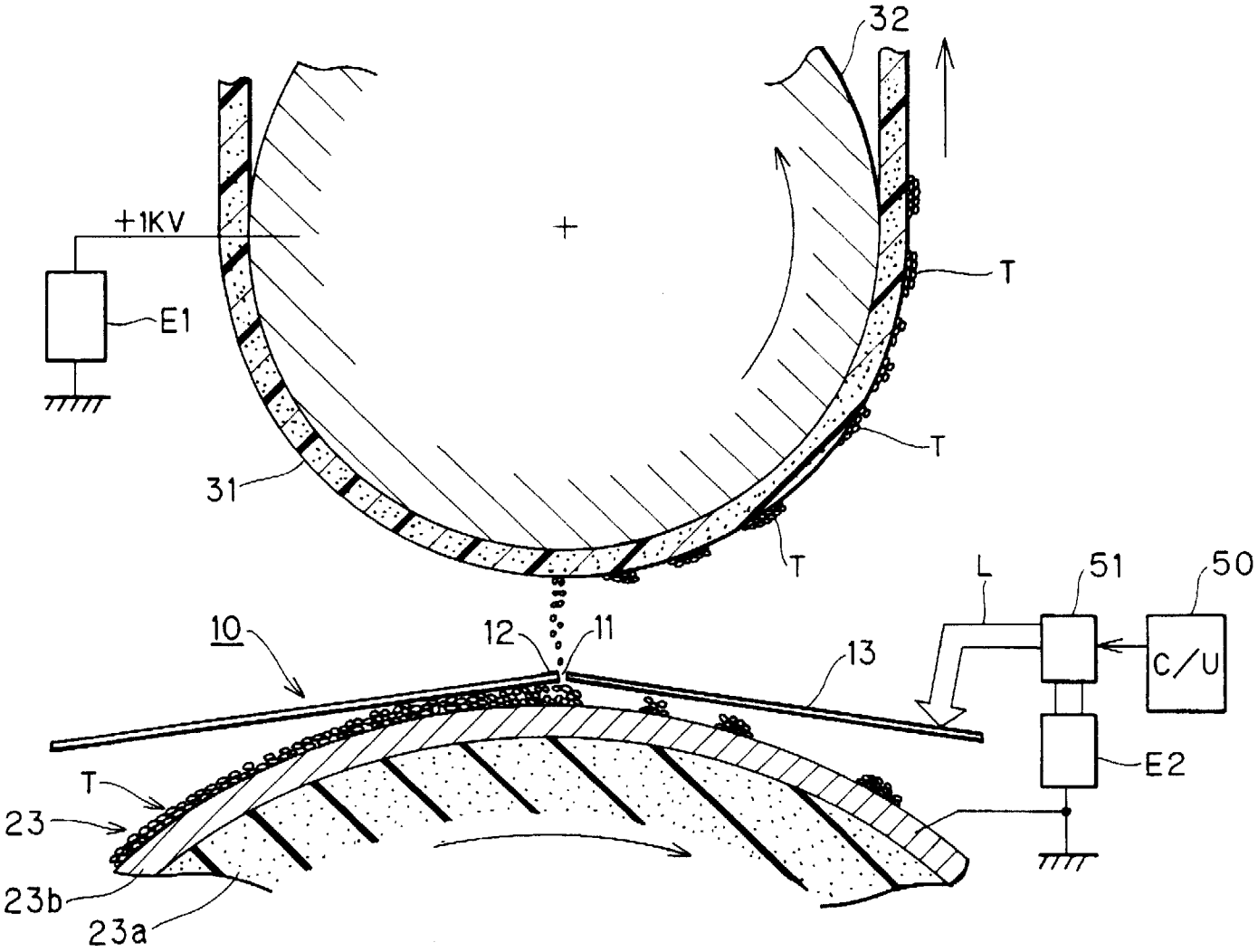
FIG. 20 is an enlarged side view showing how toner clings to an intermediate recording medium.

According to the present embodiment, as shown in FIGS. 19 and 20, the belt 31 is constructed from a thermal resister body which is made from a flexible and heat-resistant resin film of, for example, polyimide or amide resin containing a predetermined quantity of carbon powder.

A drive roller 33A is provided in place of the heat roller 33 of the first embodiment. The belt 31 is stretched around the drive roller 33A and the back electrode roller 32. A roller drive mechanism (not shown in the drawings) is connected to the drive roller 33A to rotate the drive roller 33A in synchronization with the predetermined transport speed for transporting the image recording medium P. The drive roller 33A is resiliently urged upward so as to constantly apply a predetermined tension to the belt 31. The rotation of the belt 31, which is driven by rotation drive of the drive roller 33A, drives the back electrode roller 32 and the pressure roller 34 to rotate.

The pressure roller 34 is formed from a heat-resistant synthetic resin compound, and is disposed parallel to the drive roller 33A and in pressing contact with the drive roller 33A via the belt 31. The drive roller 33A and the pressure roller 34 operate in cooperation to press the image recording medium P, thereby transferring and fixing the toner image to the image recording medium P. The transfer position TP is the position where the belt 31 and the pressure roller 34 come into pressing contact.

Figure 22:
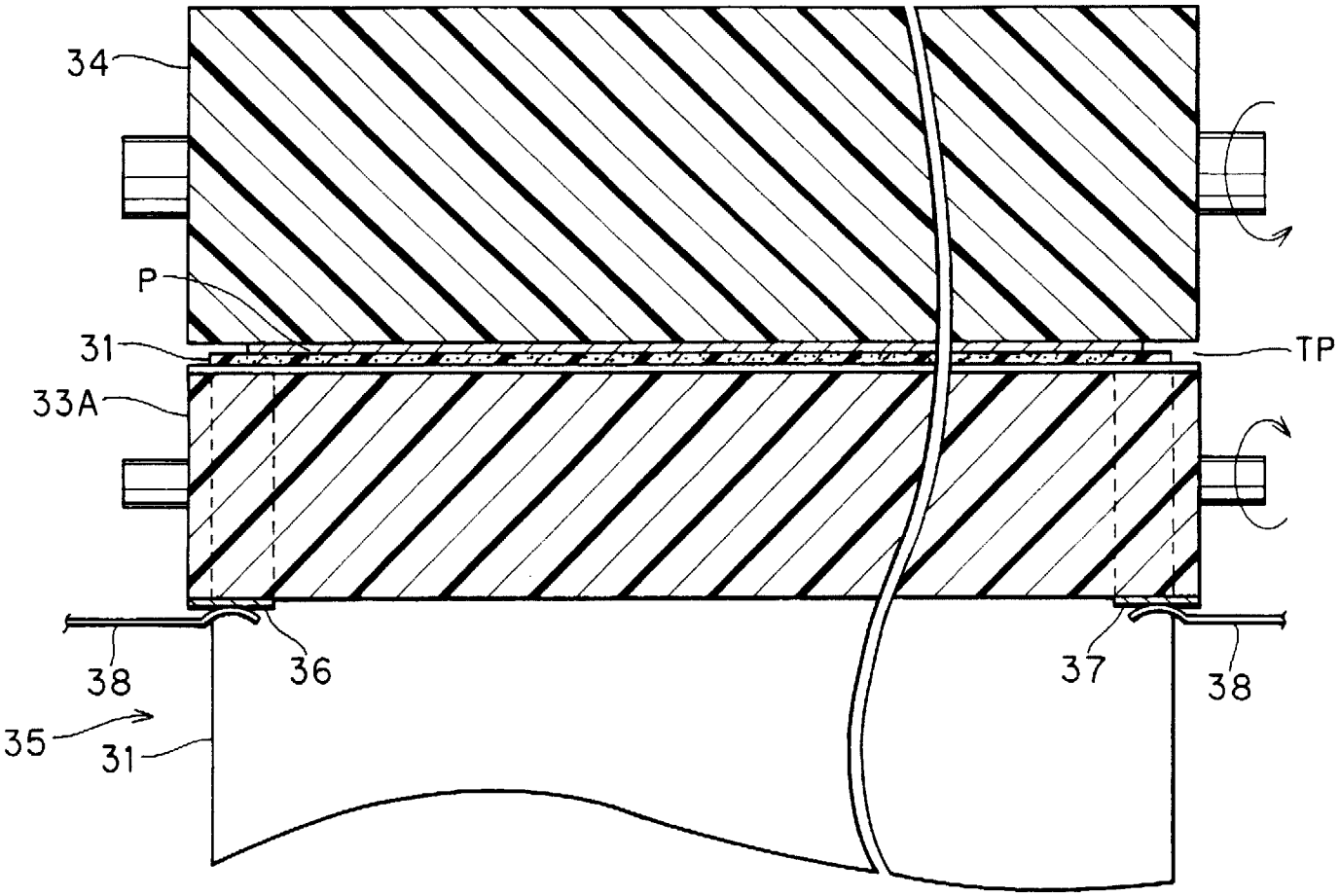
FIG. 22 is a front sectional view taken along a line A—A in FIG. 19.

According to the present embodiment, an energization mechanism, or means, 35 is provided for energizing the belt 31 to heat, as shown in FIG. 22. In the energization mechanism, a pair of ring-shaped energization electrodes 36 and 37 are attached to opposite ends of the drive roller 33A in its length wise direction. One of two energizing brushes 38 is disposed to press against one of the energization electrodes 36 and 37. A power circuit (not shown in the drawings) is provided for supplying a heating drive current to each of the energizing brushes 38.

The entire surface of a transfer operation portion of the belt 31, that is, the portion of the belt 31 at the transfer position TP and in the vicinity of the transfer position TP, is energized by contact of the energization electrodes 36 and 37. This heats the transfer operation portion to a temperature of about 130° C., where fixation of the toner T is possible. As shown in FIGS. 19 and 20, the structures of components of the image forming device 1 of this embodiment other than those as described above are the same as those of the second embodiment, except that the belt 31 of this embodiment is not formed with the rough surface.

Figure 21:
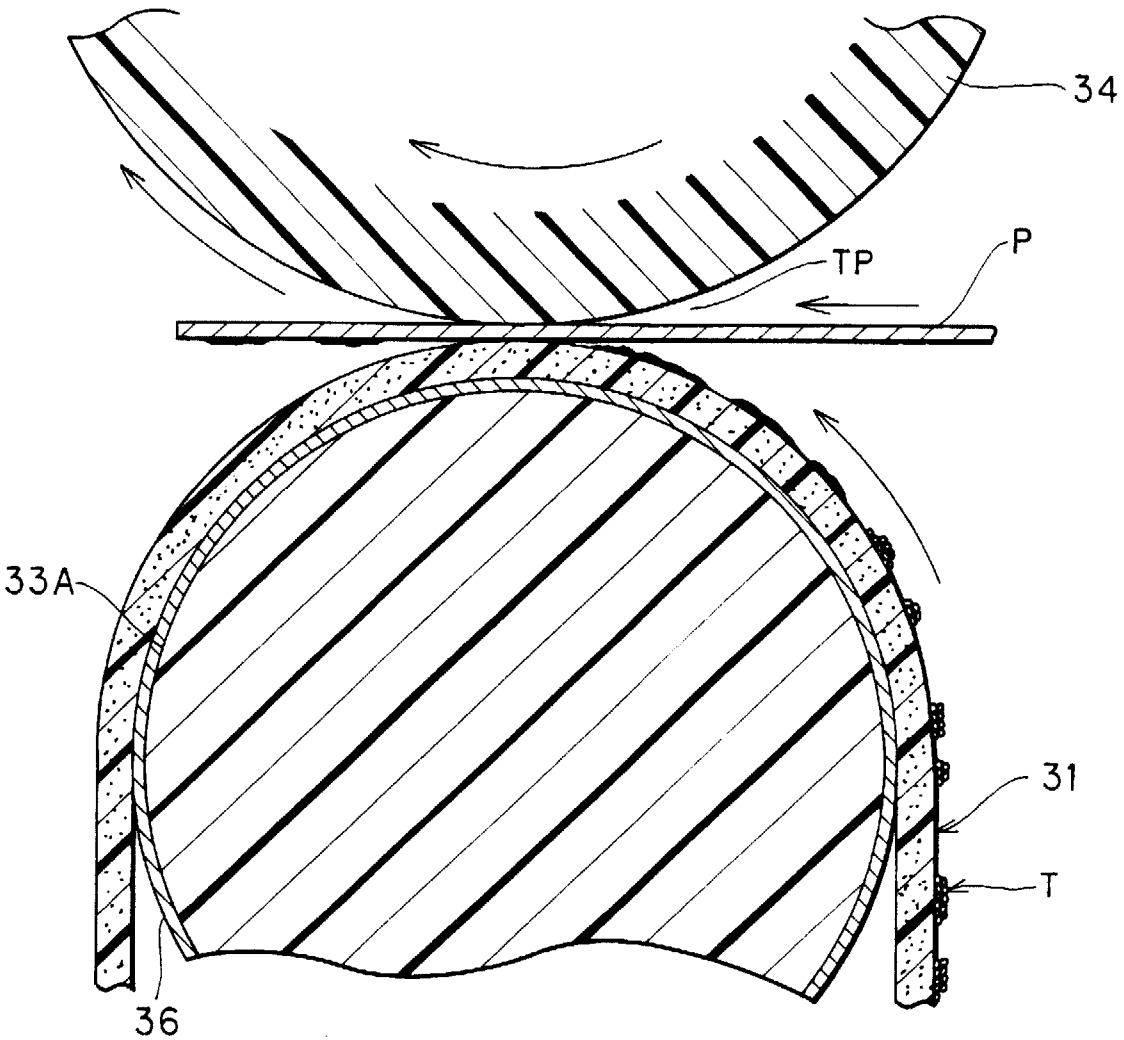
FIG. 21 is an enlarged side view illustrating how a toner image clinging to the intermediate recording medium is transferred and fixed to an image recording medium.

With the above-described structure, because the pair of energization electrodes 36 and 37, that are attached to both ends of the drive roller 33A, contact and energize the transfer operation portion of the belt 31, the transfer operation portion of the belt 31 is heated across its entire width to a temperature of 130° C., which enables fixation. That is, as shown in FIG. 21, when the toner T transported while clinging to the belt 31 approaches the transfer position TP, heating across the entire width of the transfer operation portion gradually softens it into a fixable condition. The pressure roller 34 presses the image recording medium P against the softened toner T, thereby simultaneously transferring and fixing it to the image recording medium P. Afterward, the image recording medium P is transported downstream in the transport direction to the discharge table DT.

As described above, the belt 31 is constructed from a thermal resistor. Also, energization electrodes 36 and 37 are provided at either ends of the drive roller 33A. The energization electrodes 36 and 37 energize the transfer operation portion of the belt 31, that is, the portion of the belt 31 positioned at the predetermined transfer position TP and in the vicinity of the transfer position TP. This heats up the transfer operation portion so that the toner image clinging to the belt 31 is simultaneously transferred to and fixed to the image recording medium P. Therefore, there is no need to provide both a transfer mechanism and a fixation mechanism to the image forming device, allowing design of a compact image forming device 1. Also, warm up is efficient because only the transfer operation portion of the belt 31 is heated. Therefore, fixation processes can be performed soon after power is turned on.

Figure 23:
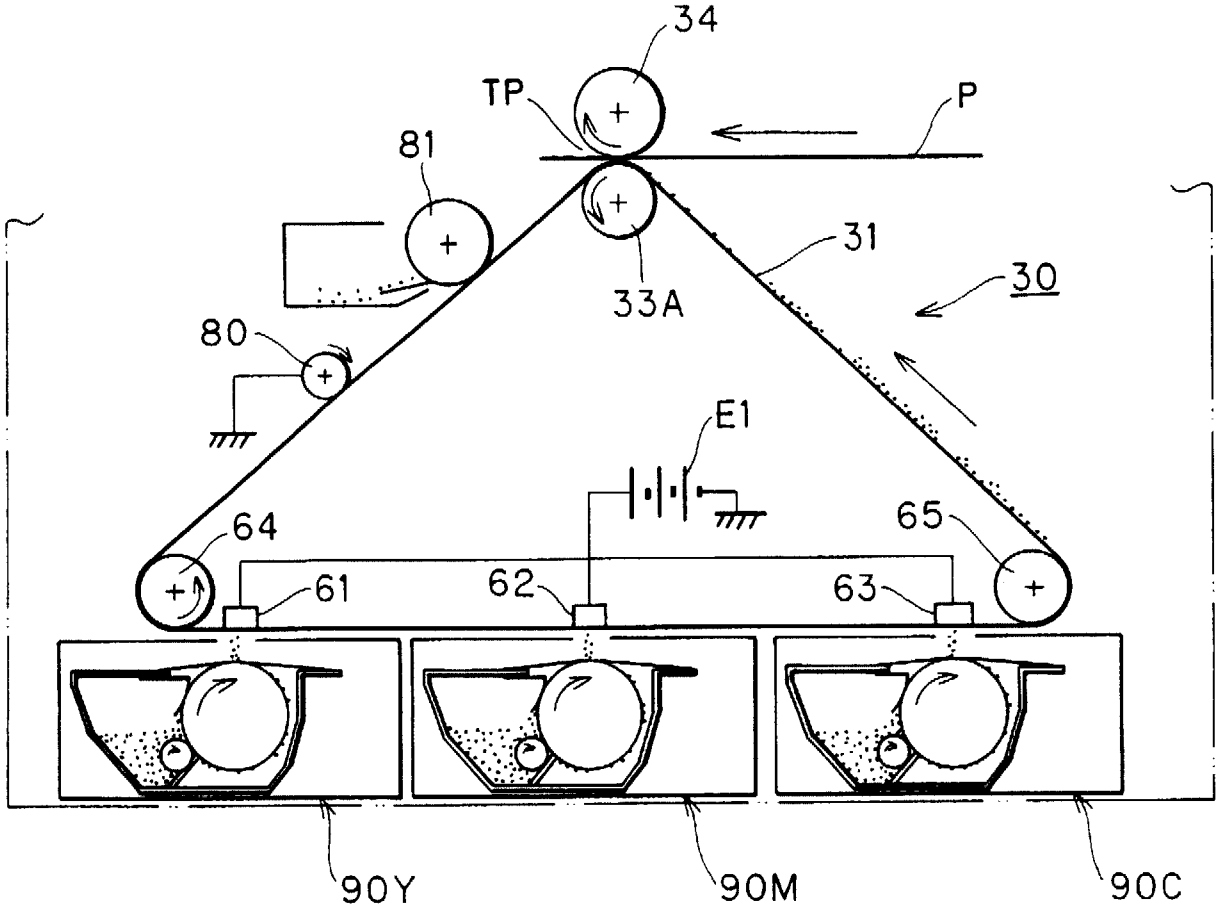
FIG. 23 is a modification of the fourth embodiment to a full-color image forming device.

FIG. 23 shows modification of the present embodiment to a full-color image forming device 1. In this device, the drive roller 33A is constructed in the same way as the drive roller 33A described above with reference to FIG. 22. The belt 31 is formed from a heat resistor also described above. Other components are the same as those of the full-color image forming device of FIG. 5.

Figure 24:
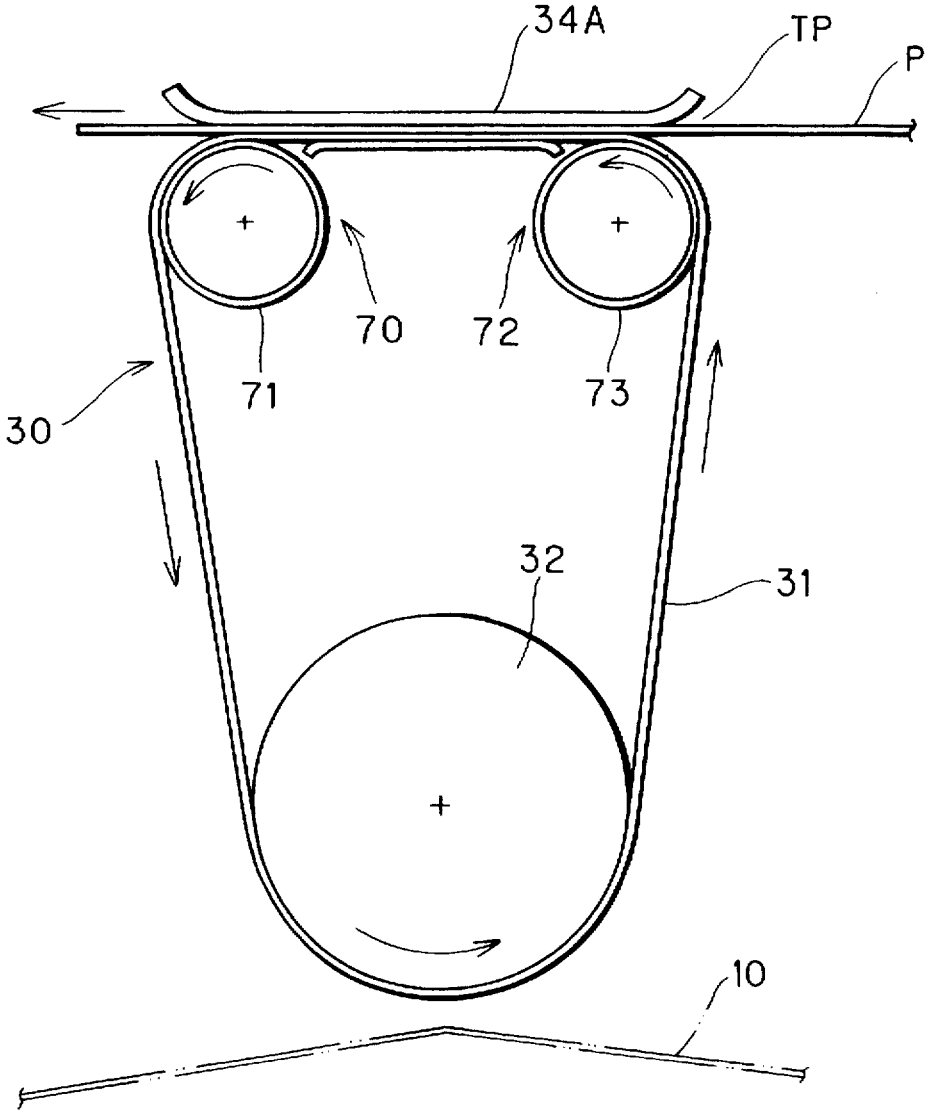
FIG. 24 shows another modification of the fourth embodiment where the intermediate recording medium is stretched around two rollers and a back electrode roller.

Another modification of the present embodiment is shown in FIG. 24. A heat-resistant pressing plate 34A is installed in place of the pressing roller 34 (thus, the pressing plate 34A and roller 70, 72 with belt 31 therebetween are the second transporting mechanism). In place of the roller 33A, a first drive roller 70 and a second drive roller 72 are provided at the transfer position TP in parallel and separated from each other by a predetermined space (the rollers 32, 70, 72 are the first transporting mechanism). Further, the back electrode roller 32 is provided near to, and in opposition to, the aperture electrode body 10. Also, a first energization electrode 71 is fixed to the periphery of the first drive roller 70 and a second energization electrode 73 is fixed to the periphery of the second drive roller 72.

Although not shown in the drawing, a control mechanism is provided for energizing both energization electrodes 71 and 73 and for driving both the first and second drive rollers 70 and 72. Accordingly, the belt 31 is energized and heated in the range falling across its entire width and between the first energizing electrode 71 of the first roller 70 and the second energizing electrode 73 of the second roller 72. When the electrodes 71 and 73 are thus energized, electric current flows across the entire width of the belt 31 between the rollers 70 and 72 with a uniform current density. Therefore, thermal distribution across this range will be substantially uniform so that more stable fixation processes can be anticipated. It should be noted that the energization electrodes can be omitted if the first and second drive rollers 70 and 72 are constructed entirely from a metal conductor, the belt 31, rollers 70, 72, with the pressing plate 34A, forming a transfer device.

Figure 25:
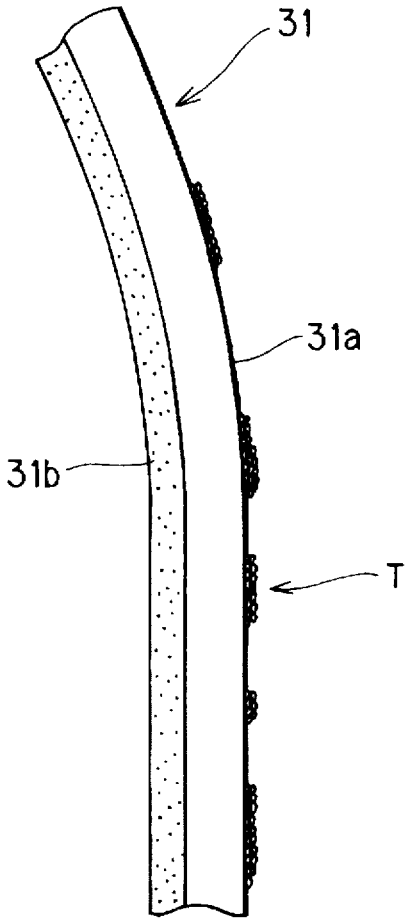
FIG. 25 is an enlarged side view showing a part of the intermediate recording medium constructed from a heat resistor and an insulation film.

FIG. 25 shows another example of the belt 31 of the present embodiment wherein the belt 31 is formed from a flexible insulation film 31*a* and a thermal resistor body 31*b* adhered to the inner periphery of the insulation film 31*a*. In this example, the insulation film 31*a* is made from polyimide resin, or some other material with excellent heat resistance, to a thickness of between 25 and 100 μm. The thermal resistor body 31*b* is formed from polyimide resin containing carbon particles. The resistor body 31*b* is energized to heat while toner T, charged to a predetermined polarity, clings reliably to the insulation film 31*a*.

As described above, according to the image forming device of the fourth embodiment, the image forming unit (21, 10) forms a toner image from toner charged with a predetermined polarity. The intermediate recording medium 31 receives the toner image formed by the image forming unit. The drive unit drives transport of the intermediate recording medium to the predetermined transfer position TP where the toner image is transferred from the intermediate recording medium to an image recording medium P. The intermediate recording medium includes a thermal resistor. The energizing unit 35 energizes at least a transfer operation portion of the intermediate recording medium which includes the transfer position and a portion in the vicinity of the transfer portion. This heats up the transfer operation portion so that the toner image clinging to the intermediate recording medium is simultaneously transferred to and fixed to the image recording medium. Therefore, there is no need to provide both a transfer mechanism and a fixation mechanism to the image forming device, allowing design of a compact image forming device. Also, warm up is efficient because only the transfer operation portion of the intermediate recording medium is heated. Therefore, fixation processes can be performed soon after power is turned on.

The intermediate recording medium 31 includes an endless belt having a width greater than or equal to a maximum width of the recording medium. The drive unit drives the intermediate recording medium using the first roller 33 provided at the transfer position TP and the second roller 32 provided near to and in opposition to the image forming unit, as shown in FIG. 19. Therefore, all of the toner image clinging to the intermediate recording medium can be simultaneously and serially transferred and fixed to the image recording medium at the transfer position. Also, images can be formed on relatively thick recording mediums made from various materials.

The energizing unit is provided at both edges of the first roller, and includes a pair of energization electrodes 36, 37 each in contact with a respective one edge in a width direction of the thermal resistor of the intermediate recording medium. Only the transfer operation portion of the rotatingly driven intermediate recording medium is energized by contact with the pair of energizing electrodes. Accordingly, the transfer operation portion only can be efficiently and easily heated across its entire width.

In one example, the intermediate recording medium 31 is formed entirely from the thermal resistor. Therefore, the intermediate recording medium can be produced from a thermal resistor by incorporating a heat-generating material, such as metal or carbon, into a heat-resistant base material, such as polyimide. Additionally, the amount of heat generated by the intermediate recording medium can be easily determined by adjusting the amount of heat-generating material incorporated into the heat-resistant base material.

In the example of FIG. 25, the intermediate recording medium 31 includes a thermal resistor 31*b* and an insulating film 31*a* provided at an outer periphery of the thermal resistor. The thermal resistor body can be energized and heated via an energization electrode. Also, the toner, that is charged to a predetermined polarity, can be effectively transported while clinging to the insulation film.

In the example of FIG. 24, the intermediate recording medium 31 includes an endless belt having a width greater than or equal to a maximum width of the recording medium. The drive unit includes a first roller 70 and a second roller 72 disposed at the transfer position TP in parallel with each other and separated by a predetermined distance. The energizing unit 35 includes the first energizing electrode 71 provided at a peripheral surface of the first roller and the second energizing electrode 73 provided at a peripheral surface of the second roller. The intermediate recording medium is energized and heated in its entire width between the first energizing electrode of the first roller and the second energizing electrode of the second roller. When the electrodes are energized, electric current flows across the entire width of the intermediate recording medium between the rollers with a uniform current density. Therefore, thermal distribution across this range will be substantially uniform so that a stable fixation processes can be anticipated.

It is noted that in the above-described fourth embodiment, the toner first clings to the intermediate recording medium 31 as a result of the relatively large electrostatic force generated by the back electrode 32. As the intermediate recording medium 31 moves, the toner moves away from the back electrode 32 and toward the transfer position TP. The toner, however, clings to the intermediate recording medium 31 by van der Waals forces and intermolecular forces among toner and image forces occurred between the toner and the intermediate recording medium. Accordingly, the toner can be reliably transported by the intermediate recording medium 31 to the transfer position TP, where the toner is transferred to the image recording medium P. The image forming device of the fourth embodiment can therefore form clean pixels and images. However, the fourth embodiment can be combined with the methods of the second and third embodiments for improving the tenacity with which toner clings to the intermediate recording medium 31. Also, the present embodiment can be applied to various image recording devices that control clinging of toner T to recording sheet P using the aperture electrode body 10, an electrophotography method or the like.

While the invention has been described in detail with reference to specific embodiments thereof, it would be apparent to those skilled in the art that various changes and modifications may be made therein without departing from the spirit of the invention, the scope of which is defined by the attached claims.

What is claimed is:

1. An image forming device for forming a toner image on an image recording medium, the device comprising:

an aperture electrode body formed with a plurality of apertures and having an electrode for each aperture of the plurality of apertures;

a toner supply unit for supplying toner to the plurality of apertures of the aperture electrode body;

a toner controller for controlling passage of toner through the apertures by individually controlling a voltage supplied to each electrode of the aperture electrode body;

an intermediate recording medium provided on an opposite side of the aperture electrode body than the toner supply unit, toner having passed through the apertures of the aperture electrode body adhering to the intermediate recording medium to form a toner image on the intermediate recording medium, the intermediate recording medium transporting the toner image to a predetermined transfer position; and a transfer device for heating the toner image while the intermediate recording medium is in contact with the image recording medium at the transfer position, thereby simultaneously transferring and fixing the toner image to the image recording medium.

2. An image forming device of claim 1, wherein the transfer device includes:

a pressing mechanism for pressing the image recording medium against the intermediate recording medium at the transport position; and a heater, disposed in opposition to the pressing mechanism and sandwiching the intermediate recording medium and the image recording medium between the heater and the pressing mechanism, for heating the intermediate recording medium.

3. An image forming device of claim 1, wherein the intermediate recording medium is of a belt shape stretched around at least two rollers, further comprising driving mechanism for driving the -rollers to rotate and transport the intermediate recording medium.

4. An image forming device of claim 3, wherein the at least two rollers includes a heat roller, disposed at the transfer position, for bringing the intermediate recording medium into contact with the image recording medium while heating the intermediate recording medium.

5. An image forming device of claim 4, further comprising-a pressing roller, disposed in opposition to the heat, roller, for sandwiching the intermediate recording medium and the image recording medium between the pressing roller and the heat roller, thereby pressingly contact the intermediate recording medium to the image recording medium.

6. An image forming device of, claim 4, wherein the at least two rollers include a back electrode roller opposing the aperture electrode body with the intermediate recording medium passing around the back electrode roller and opposite to the aperture electrode body, the back electrode roller being supplied with a voltage for drawing toner having passed through apertures of the aperture electrode body toward the intermediate recording medium.

7. An image forming device of claim 1, wherein a plurality of aperture electrode bodies are provided in opposition to the intermediate recording medium, a toner supplying unit being provided for each aperture electrode body for supplying toner to the aperture electrode body, wherein the toner controller controls passage of toner through the apertures of each aperture electrode body by individually controlling the voltage supplied to the corresponding electrodes.

8. An image forming device of claim 1, wherein the intermediate recording medium is formed with a rough surface for boosting adhesion of toner to the intermediate recording medium.

9. The image forming device of claim 8, wherein roughness at the rough surface of the intermediate recording medium is formed with maximum peaks within a range of 0.1 microns to 10.0 microns.

10. The image forming device of claim 1, further comprising a preheater for heating toner adhered to the intermediate recording medium to soften the toner, thereby increasing the adhesion of the toner to the intermediate recording medium.

11. An image forming device of claim 10, wherein the preheater heats the intermediate recording medium, thereby heating and softening the toner adhering to the intermediate recording medium.

12. An image forming device of claim 10, wherein the preheater directly heats the toner adhering to the intermediate recording medium.

13. An image forming device of claim 1, further comprising:

a first transporting mechanism for transporting the image recording medium; and a second transporting mechanism for causing the intermediate recording medium to transport the toner image in synchronization with the transportation of the image recording medium.

14. An image forming device of claim 1, wherein the intermediate recording medium has a thermal resistor component, and further comprising an energization mechanism for energizing thermal resistance of the intermediate recording medium at least at the transfer position so as to thermally fix the toner image to the image recording medium.

15. An image forming device of claim 14, wherein the intermediate recording medium includes an endless belt stretched around a first roller provided at the transfer position and a second roller provided near to and in opposition to the toner supply unit, the first and second rollers being driven by a drive train for transporting the intermediate recording medium.

16. An image forming device of claim 15, wherein the energizing means includes a pair of energization electrodes provided at both edges of the first roller, each in contact with a corresponding edge in a width direction of the thermal resistor component of the intermediate recording medium.

17. An image forming device of claim 15, wherein the thermal resistor component is the entire intermediate recording medium.

18. An image forming device of claim 15, wherein the intermediate recording medium includes a thermal resistor layer as the thermal resistor component and an insulating film is provided at an outer surface of the thermal resistor layer.

19. An image forming device of claim 14, wherein the intermediate recording medium includes an endless belt stretched around at least two rollers disposed at the transfer position in parallel with each other and separated by a predetermined distance, the energization mechanism including energizing electrodes provided at the peripheral surfaces of the two rollers.

20. An image forming device for forming a toner image on an image recording medium, comprising:

a transport mechanism for transporting an image recording medium;

an aperture electrode body formed with a plurality of apertures through which toner is to pass and having a control electrode formed to each aperture;

a toner supplying mechanism for supplying charged toner to each aperture;

a control electrode driver for controlling, according to an image signal inputted from an external source, a voltage applied between each control electrode and the toner supplying mechanism, thereby controlling passage, through the apertures, of toner supplied by the toner supplying mechanism to the apertures;

a back electrode positioned so that the aperture electrode body is between the toner supplying mechanism and the back electrode, the back electrode being supplied a predetermined voltage for forming a predetermined electric field between the back electrode and the toner supplying mechanism so that toner that passes through the apertures is drawn toward the back electrode;

an intermediate recording medium disposed between the back electrode and the aperture electrode body so that a toner image is formed on the intermediate recording medium from toner that passes through the apertures, that is drawn toward the back electrode, and that clings to and accumulates on the intermediate recording medium, the intermediate recording medium transporting the toner image to a transport path of the image recording medium; and a transfer device for transferring the toner image formed on the intermediate recording medium to the image recording medium and for fixing the toner image to the recording medium, the transfer device including a pressing mechanism and a heater disposed in opposition to each other and sandwiching the image recording medium therebetween, the pressing mechanism pressing the image recording medium against the intermediate recording medium and the heater heating the intermediate recording medium.

21. An image forming device of claim 20, wherein the intermediate recording medium has a belt shape and is stretched between at a least a roller which serves as the back electrode and a roller which serves as the heater.

22. An image forming device for forming a toner image on an image recording medium, the device comprising:

a first transporting mechanism transporting an image recording medium;

an aperture electrode body formed with a plurality of apertures in a row aligned in a widthwise direction of a recording medium and formed with an electrode for each of the plurality of apertures;

a toner supply mechanism for supplying toner to the apertures of the aperture electrode body;

a toner controller for controlling passage of toner through the apertures by individually controlling a voltage supplied to each of the electrodes of the aperture electrode body;

an intermediate recording medium provided on an opposite side of the aperture electrode body than the toner supply mechanism, toner adhering to the intermediate recording medium, the intermediate recording medium being formed with a rough surface for boosting adherence of the toner to the image recording medium; and a second transporting mechanism transporting the intermediate recording medium in synchronization with transport of the recording medium to a transfer position where the intermediate recording medium contacts the image recording medium, thereby causing the toner to be transferred from the intermediate recording medium to the image recording medium.

23. The image forming device of claim 22, wherein roughness at the rough surface of the intermediate recording medium is formed with maximum peaks within arrange of 0.1 microns to 10.0 microns.

24. An image forming device for forming a toner image on an image recording medium, the device comprising:

a first transporting mechanism transporting an image recording medium;

an aperture electrode body formed with a plurality of apertures in a row aligned in a widthwise direction of a recording medium and formed with an electrode for each of the plurality of apertures;

a toner supply mechanism for supplying toner to apertures of the aperture electrode body;

a toner controller controlling passage of toner through the apertures by individually controlling a voltage supplied to each of the electrodes of the aperture electrode body; an intermediate recording medium provided on an opposite side of the aperture electrode body than the toner supply mechanism, toner adhering to the intermediate recording medium;

a preheater that increases adherence of the toner to the intermediate recording medium by heating and softening the toner; and a second transporting mechanism transporting the intermediate recording medium in synchronization with transport of the recording medium to a transfer position where the intermediate recording medium contacts the image recording medium, thereby causing the toner to be transferred from the intermediate recording medium to the image recording medium, wherein the preheater is external to the intermediate recording medium and directly heats the toner adhering to the intermediate recording medium.

25. An image forming device for forming a toner image on an image recording medium, the device comprising:

an image forming mechanism forming a toner image from toner charged with a predetermined polarity;

an intermediate recording medium for transporting the toner image formed by the image forming mechanism to a predetermined transfer position where the intermediate recording medium contacts an image recording medium to allow the toner image to be transferred from the intermediate recording medium to the image recording medium, the intermediate recording medium including a thermal resistor;

a drive mechanism for causing the intermediate recording medium to transport the toner image to the transfer position; and an energization mechanism for energizing a transfer operation portion of the intermediate recording medium by heating the transfer operation portion to thermally fix the toner image to the image recording medium at the transfer position.

26. An image forming device of claim 25, wherein the intermediate recording medium includes an endless belt having a width greater than or equal to a maximum width of the image recording medium and wherein the drive mechanism drives the intermediate recording medium using a first roller provided at the transfer position and a second roller provided near to and in opposition to the image forming mechanism.

27. An image forming device of claim 26, wherein the energization mechanism includes a pair of energization electrodes provided at both edges of the first roller in contact with corresponding edges in a width direction of the thermal resistor of the intermediate recording medium.

28. An image forming device claim 27, wherein the intermediate recording medium is formed entirely from the thermal resistor.

29. An image forming device claim 27, wherein the intermediate recording medium includes a thermal resistor layer and an insulating film provided at an outer surface of the thermal resistor.

30. An image forming device claim 25, wherein the intermediate recording medium includes an endless belt having a width greater than or equal to a maximum width of the recording medium, and the drive mechanism includes a pair of rollers disposed at the transfer position in parallel with each other and separated by a predetermined distance, the energization mechanism including a pair of energizing electrodes provided to the pair of rollers.

31. The image forming apparatus according to claim 24, wherein the preheater heats the toner from a side of the intermediate recording medium that has the toner adhered thereto.

32. The image forming apparatus according to claim 31, further comprising a heater located at the transfer position for thermally fixing the toner onto the image recording medium.

* * * * *